US005729658A

United States Patent [19]

Hou et al.

[11] Patent Number: 5,729,658

[45] Date of Patent: Mar. 17, 1998

[54] EVALUATING INTELLIGIBILITY OF SPEECH REPRODUCTION AND TRANSMISSION ACROSS MULTIPLE LISTENING CONDITIONS

[75] Inventors: Zezhang Hou, Cambridge; Aaron R. Thornton, Boston, both of Mass.

[73] Assignee: Massachusetts Eye and Ear Infirmary, Boston, Mass.

[21] Appl. No.: 261,929

[22] Filed: Jun. 17, 1994

[51] Int. Cl.[6] ..... G10L 3/00

[52] U.S. Cl. ..... 395/2.79; 381/60

[58] Field of Search ..... 395/2, 2.09, 2.79; 381/41, 68, 68.1–68.7, 58, 60

[56] References Cited

U.S. PATENT DOCUMENTS

| | | | |
|---|---|---|---|
| 4,548,082 | 10/1985 | Engebretson et al. | 73/585 |
| 5,029,217 | 7/1991 | Chabries et al. | 381/68.2 |
| 5,278,910 | 1/1994 | Suzuki et al. | 381/41 |
| 5,434,924 | 7/1995 | Jampolsky | 381/68.4 |

OTHER PUBLICATIONS

American National Standards Institute, Inc., "Methods for the Calculation of the Articulation Index," s3.5–1969.

American National Standards Institute, Proposed Standard s3.79: "American National Standards Methods for the Calculation of the Speech Intelligibility Index," 3:1–57 (1993).

Berger, et al. "A Method of Hearing Aid Prescription," Hearing Instruments, 29(6):12–13 (1978).

Byrne, et al. "The National Acoustic Laboratories' (NAL) New Procedure for Selecting the Gain and Frequency Response of a Hearing Aid", Ear and Hearing 7(4):257–265 (1986).

Byrne, D. "Implications of the National Acoustic Laboratories' (NAL) Research for Hearing Aid Gain and Frequency Response Selection Strategies," Chapter 8 from Studebaker and Hochberg, eds: Acoustical Factors Affecting Hearing Aid Performance, Allyn and Bacon, Boston, pp. 119–131 (1993).

Dubno, et al. "Stop–consonant Recognition for Normal–hearing Listeners and Listeners with High–frequency Hearing Loss. . . " Journal of Acoustical Society of America, 85(1):355–364 (1989).

(List continued on next page.)

*Primary Examiner*—Allen R. MacDonald
*Assistant Examiner*—Richemond Dorvil
*Attorney, Agent, or Firm*—Fish & Richardson P.C.

[57] ABSTRACT

A method of calculating a single number summarizing the performance of a device for transmitting, amplifying, or reproducing acoustic speech signals. The number can be used for evaluation and comparison of characteristics of devices for conveying speech, for instance to choose a hearing aid prescription. In the method, for each device of a plurality of acoustic devices, intelligibility measurements are obtained for speech signals transmitted from or reproduced by the device under multiple of listening conditions, and a weighted sum of the device's intelligibility measurements is formed. From among the plurality of devices, the one device best overall suited to the plurality of listening conditions is chosen by comparing the weighted sums and selecting the device with the largest corresponding weighted sum. The devices may be computer models of real acoustic devices; a plurality of the models are iteratively generated and the weighted sums corresponding to the computer models are evaluated, and modelled acoustic properties of successive ones of the computer models are altered to increase the weighted sum.

18 Claims, 17 Drawing Sheets

OTHER PUBLICATIONS

Dugal, et al. "Implications of Previous Research for the Selection of Frequency–gain Characteristics," Chapter 17 of Studebaker and Hochberg, eds: Acoustical Factors Affecting Hearing Aid Performance Baltimore: University Park, 1980:379–403.

Fletcher, H. "The Perception of Speech Sounds by Deafened Persons," Journal of the Acoustical Society of America, 24(5):490–497 (1952).

Humes, L. "An Evaluation of Several Rationales for Selecting Hearing Aid Gain," Journal of Speech and Hearing Disorders, 51:272–281 (1986).

Humes, L. et al: "Recognition of Nonsense Syllables by Hearing–impaired Listeners and by Noise–masked Normal Hearers", Journal of Acoustical Society of America, 81:765–773 (1987).

Libby, R. "The 1/3–2/3 Insertion Gain Hearing Aid Selection Guide," Hearing Instruments, 37(3):27–28 (1986).

Licklider, J. "Effects of Amplitude Distortion upon the Intelligibility of Speech," The Journal of Acoustical Society of America, 18(2):429–434 (1946).

McCandless, et al. "Prescription of Gain/Output (POGO) for Hearing Aids,"Hearing Instruments, 34:16–21 (1983).

Mueller, et al. "An Easy Method for Calculating the Articulation Index," Hearing J., 43(9):14–17 (1990).

Pavlovic, C. "Use of the Articulation Index for Assessing residual auditory function in listeners with Sensorineural Hearing Impairment," Journal of Acoustical Society of America, 75:1253–1258 (1984).

Pavlovic, et al. "An Evaluation of some Assumptions Underlying the Articulation Index,"Journal of Acoustical Society of America, 75:1606–1612 (1984).

Pavlovic, et al. "An Articulation Index Based Procedure for Predicting the Speech Recognition Performance of Hearing–impaired Individuals," Acoustical Society of America, 80:50–57 (1986).

Pavlovic, C. "Derivation of Primary Parameters and Procedures for use in Speech Intelligibility Predictions," Journal of Acoustical Society of America, 82:413–422 (1987).

Pavlovic, C. "Articulation Index Predictions of Speech Intelligibility in Hearing Aid Selection," ASHA, 30(6):63–65 (1988).

Pavlovic, C. "Speech Spectrum Considerations and Speech Intelligibility Predictions in Hearing Aid Evaluations," Journal Speech and Hearing Disorders, 54:3–8 (1989).

Radley, et al. "Hearing Aids and Audiometers," London: Medical Research Council Special Report Series, 261, Her Majesty's Stationery Office, 1947.

Rankovic, C. "An Application of the Articulation Index to Hearing Aid Fitting," Journal of Speech and Hearing Research, 34:391–402 (1991).

Studebaker, G. et al. "Frequency–importance and Transfer Functions for Recorded CID W–22 Word Lists," Journal of Speech and Hearing, 34:427–438 (1991).

Thornton, et al. "Innovations in Computer Assisted Audiometry," ASHA (A), 34:148 (1992).

Wathen–Dunn, et al. "On the Power Gained by Clipping Speech in the Audio Band," Journal of Acoustical Society of America, 30(1):36–40 (1958).

Zurek, et al. "Consonant Reception in noise by listeners with Mild and Moderate Sensorineural Hearing Impairment," Journal of Acoustical Society of America, 82:1548–1559 (1987).

Steeneken, H. J. M., et al., "A Physical Method for Measuring Speech–Transmission Quality", *The Journal of the Acoustical Society of America*, vol. 67, No. 1, Jan. 1980.

AI = 0.55

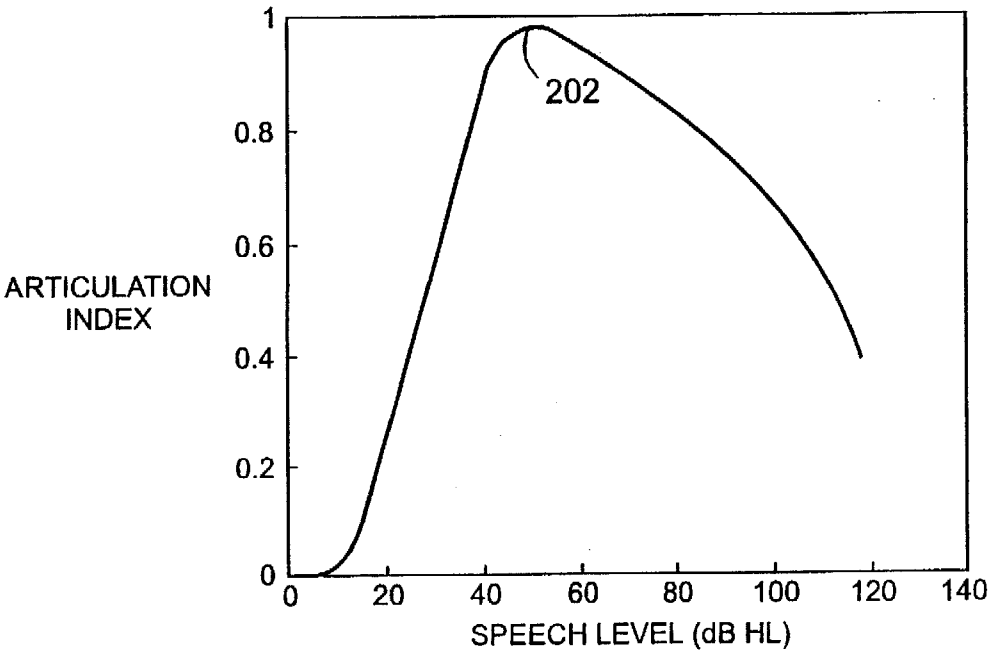
FIG. 2a
FIG. 2b
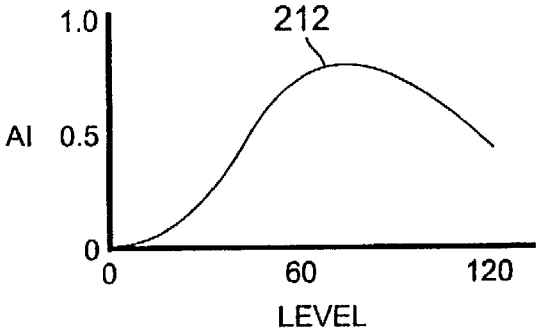
FIG. 2c

AUDIOLOGIC EVALUATION

Massachusetts Eye and Ear Infirmary
Department of Audiology

FIG. 8

NAME: JOE REDSOCK UNIT: 9876543
REFERRED BY: MCCOY AGE: 44 SEX: M
AUDIOLOGIST: Rhoda Morrison, M.A., CCC-A signature

0:00 DATE: 11/03/1993 TIME: 11:05 ROOM: 85M

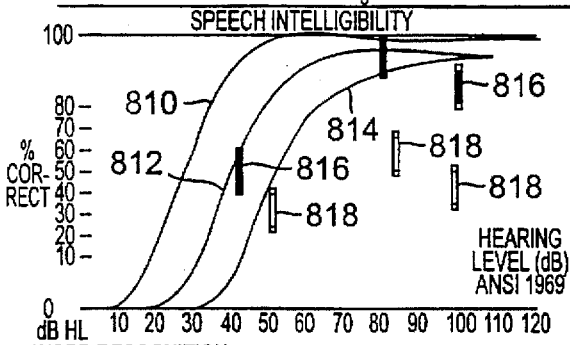

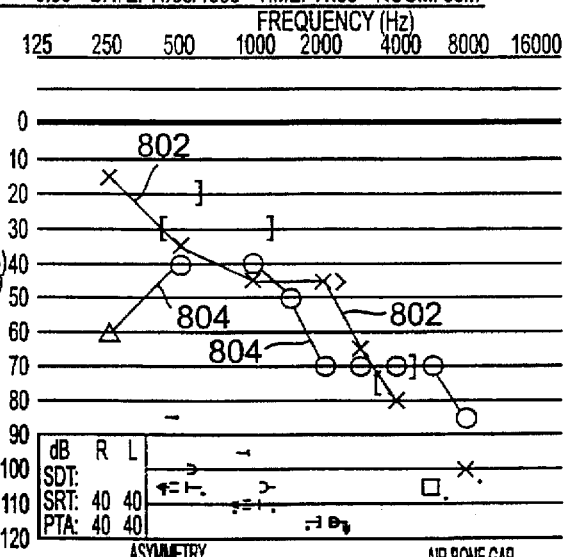

WORD RECOGNITION

| RIGHT LIST | dB | (%) | LEFT LIST | dB | (%) |
|---|---|---|---|---|---|
| W22 1A | 55 | 60 | W22 2A | 80 | 98 |
| W22 3A | 52 | 30 | W22 4A | 41 | 50 |
| W22 1B | 100 | 42 | W22 2B | 100 | 90 |

| SYMBOLS | RIGHT | LEFT |
|---|---|---|
| ARTICULATION INDEX | | |
| SPEECH SCORE | | |
| 84%CI 95%CD | | |
| 90%CI 98%CD | | |
| AIR CONDUCTION | △ | □ |
| AC MASKED | < | > |
| NO RESPONSE | [ | ] |
| ACOUSTIC REFLEX IPSILATERAL STIM | | |
| ACOUSTIC REFLEX CONTRALATERAL STIM | | |
| AIR-BONE GAP | | |

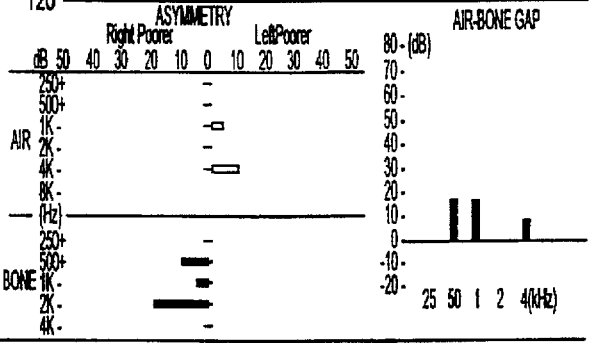

TYMPANOMETRY

| FEATURE | RIGHT | LEFT |
|---|---|---|
| VOLUME | Normal | Normal |
| PRESSURE | Normal | Normal |
| MOBILITY | Normal | Normal |
| SHAPE | Normal | Rounded |
| RESONANCE | Normal | Low |

REFLEX DECAY

| FREQUENCY | RIGHT | LEFT |
|---|---|---|
| 500 Hz | Normal | |
| 1000 Hz | Abnormal | |
| 2000 Hz | | |
| 4000 Hz | | |

HISTORY Patient reports decreased hearing, increased difficulty understanding conversation, and tinnitus in both the right and left ear for the last seven years. History of hearing loss in patient's family (mother, maternal aunt) and noise exposure (military) is reported.

IMPRESSIONS Sensory asymmetry noted with the right ear worse. This asymmetry, plus reflex and speech data may indicate a right retrocochlear lesion. Air-bone gap and tympanometry indicate otosclerosis on the left. Anticipate communication difficulties in all situations. This patient will receive significant benefit from amplification on the left.

RECOMMENDATIONS

- Return to physician.
- Results and recommendations discussed with patient.
- Hearing retest in conjunction with medical management.
- Amplification recommended. Hearing Aid Center appointment made.
- Further follow-up to evaluate asymmetry and tinnitus.
- Communication strategies discussed and handouts provided.

EVALUATING INTELLIGIBILITY OF SPEECH REPRODUCTION AND TRANSMISSION ACROSS MULTIPLE LISTENING CONDITIONS

BACKGROUND OF THE INVENTION

The invention relates to methods for evaluating the quality of devices for transmitting, amplifying, and reproducing acoustic speech signals. The invention finds specific application in determining hearing aid prescriptions.

The Articulation Index (AI) is a known criterion for evaluating the intelligibility of speech in a specific listening condition: for instance, a given speaker as heard by a person with a given hearing loss, or as heard in a room with a given level of background noise at a given speech intensity level. The AI is a function of the amplitude spectrum of a speech signal, and the amount of that spectrum that exceeds a threshold level of background noise, hearing loss, etc.. The AI may be calculated for a speech signal as directly received from a speaker, or for a speech signal heard through a transfer device or loss.

There are several known methods of determining a hearing aid prescription from a patient's hearing loss audiogram. Typically, a hearing aid prescription is chosen to improve the intelligibility of speech at a single listening condition, for instance to maximize speech audibility at 50 dB. Choosing among the prescriptions determined by these known methods is a matter of judgement for the clinician.

SUMMARY OF THE INVENTION

The invention provides a method of calculating a single number summarizing the performance of a device for transmitting, amplifying, or reproducing acoustic speech signals. This single number can be used for after-the-fact evaluation and comparison or before-the-fact determination of characteristics of many devices for conveying speech, for instance to choose a hearing aid prescription (the frequency response characteristic of the hearing aid), to determine whether a given patient would benefit from a hearing aid, to determine a frequency response for a speaker's podium microphone or air traffic control voice link, to choose from among alternative auditory surgical procedures or whether to perform surgery at all, or evaluate the hearing handicap of a patient.

In particular, the invention provides a method of evaluating and prescribing hearing aid gains to find a hearing aid prescription that best suits the multiple listening conditions in which a patient lives, without having to actually fabricate multiple hearing aids to compare against each other. The invention provides an objective criterion by which to evaluate different hearing aid prescriptions determined by known methods, and by a method provided within the invention, to select the prescription that most benefits the patient.

In a first aspect, the invention features a method having the following steps. For each device of a plurality of acoustic devices, intelligibility measurements are obtained for speech signals transmitted from or reproduced by the device under a plurality of listening conditions, and a weighted sum of the device's intelligibility measurements is formed. From among the plurality of devices, the one device best overall suited to the plurality of listening conditions is chosen by comparing the weighted sums and selecting the device with the largest corresponding weighted sum.

Preferred embodiments of the invention may include the following features. At least one of the plurality of acoustic devices is a computer model of a real acoustic device. A plurality of the computer models are iteratively generated and the weighted sums corresponding to the computer models are evaluated, and modelled acoustic properties of successive ones of the computer models are altered to increase the weighted sum. The devices may include an unaided human ear, devices for remote communication of speech, a human ear as proposed to be altered by a proposed surgical procedure, hearing aids under evaluation for prescription to a patient with a predetermined hearing loss, or multiple hearing aid prescriptions to be incorporated into a single adaptive hearing aid configured to selectively switch among the multiple prescriptions. Weights used in forming the weighted sum are determined from a history of a patient to correspond to the relative importance to the patient of the listening conditions corresponding to each of the weights. The intelligibility measurements include a factor to quantify distortion or other fidelity limitations of the device, or a factor to quantify temporal resolving ability. The weighted sums are formed by integrating the intelligibility measurements over a plurality of signal-to-noise ratios or speech intensity levels. The intelligibility measurements are computed using the Articulation Index or Speech Transmission Index methods. Two of the weighted sums are combined to form an audibility improvement index quantifying a differential benefit to a listener of the devices corresponding to the two weighted sums. A single device can be evaluated under two different weighting strategies to determine relative improvement in intelligibility gained or lost.

The invention offers the following benefits. A clinician fitting hearing aids can use the invention to quickly evaluate many possible hearing aid prescriptions and determine a prescription that offers maximum benefit to the patient, while reducing the cost of choosing from among prescriptions. The invention reduces the amount of expert knowledge required to properly fit a hearing aid, providing higher quality of fitting to the patient, and reducing costs and return rate. The invention provides an objective evaluation of hearing aid fit, which will generate a greater confidence that a very good fit has actually been found. The clinician is relieved of selecting specific condition for making comparisons among hearing aids, settings, etc.: instead, he can compare the performance of hearing aids across the listening conditions that are important to the patient. These benefits are particularly important in fitting hearing aids to young children, who cannot reliably be tested for speech discrimination performance. The computations of the method are relatively inexpensive, easily performed on the computers that are now common in audiologists' offices, and thus the invention can be combined with other procedures at relatively low cost.

Other advantages and features of the invention will become apparent from the following description of preferred embodiments, from the drawings, and from the claims.

BRIEF DESCRIPTION OF THE DRAWING

FIGS. 2*a* and 2*c* plot AI as a function of speech intensity level.

FIG. 2*b* is a graph that plots speech recognition score as a function of AI.

FIG. 8 is a patient chart produced by a computer.

DESCRIPTION OF THE PREFERRED EMBODIMENTS

The Integrated Articulation Index (IAI) is an objective representation of the average intelligibility of speech to a listener, and is computed from measurements of the transfer characteristics of the acoustic media (including any amplification devices, etc.) between various speakers and the listener, a set of listening conditions important to the listener, and importance weights assigned to the listening conditions. Many characteristics of the listening conditions can be incorporated into a calculation of a specific IAI, each with its own corresponding weighting function. For each listening condition, the ANSI Articulation Index (AI) is computed, and then these condition-specific AI's are combined using a weighted sum or integration to form an IAI. IAI's for different devices can be combined to form an Audibility Improvement Index (AII), which numerically states how much improvement a listener can expect to perceive.

When alteration of the listener's hearing or listening conditions is under consideration, for instance by adding a hearing aid or replacing a two-way radio system, the IAI can be recalculated for the proposed alteration. This altered IAI can be compared to the unaltered IAI to determine whether the listener will perceive a net improvement in speech intelligibility and whether the cost of the alteration is warranted in view of the amount of improvement. Or several proposed alterations can be evaluated against each other to determine the most beneficial.

The Articulation Index (AI)

Figures 1A, 1D:
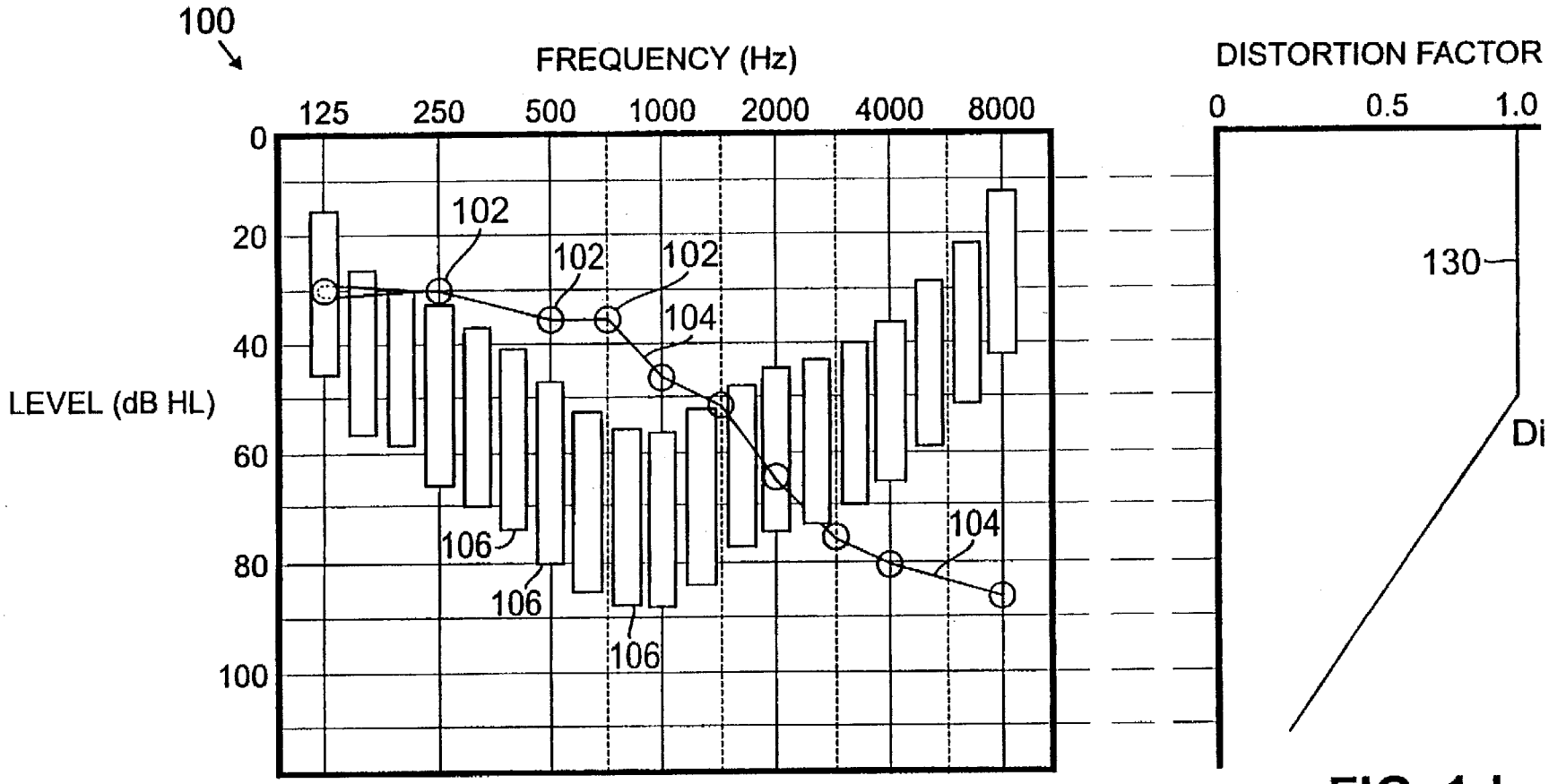
FIG. 1*a* is a patient audiogram. The circles and lines show the patient's high-frequency hearing loss and the bars show a frequency spectrum of speech.
FIG. 1*d* is a graph of a distortion factor of AI.
Figure 1B:
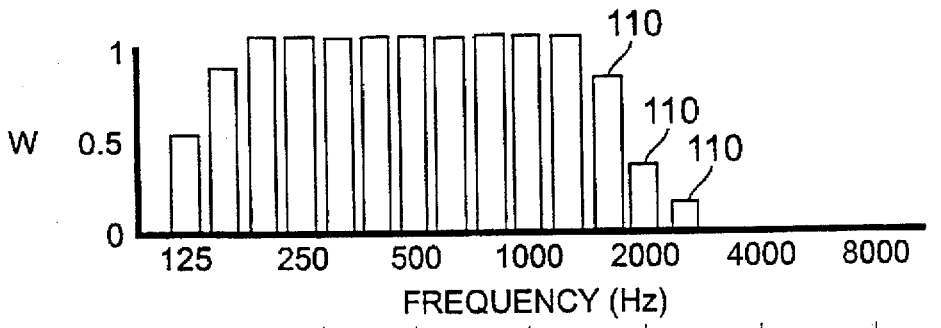
FIGS. 1*b*, 1*c*, 1*e*, and 1*f* are bar graphs showing terms in the computation of the Articulation Index (AI).
Figure 1C:
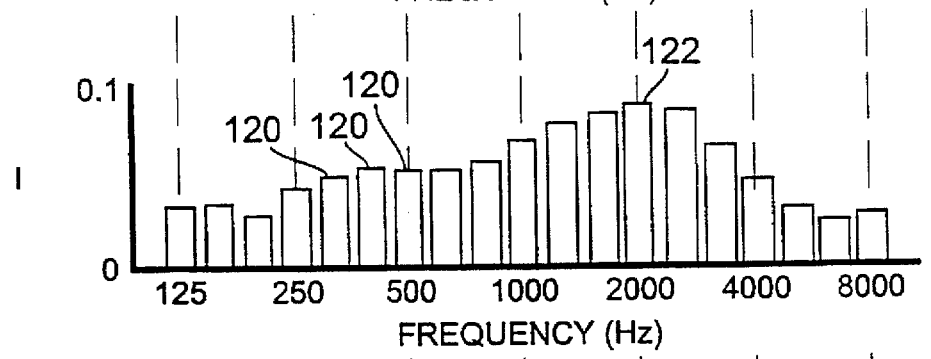
Figure 1E:
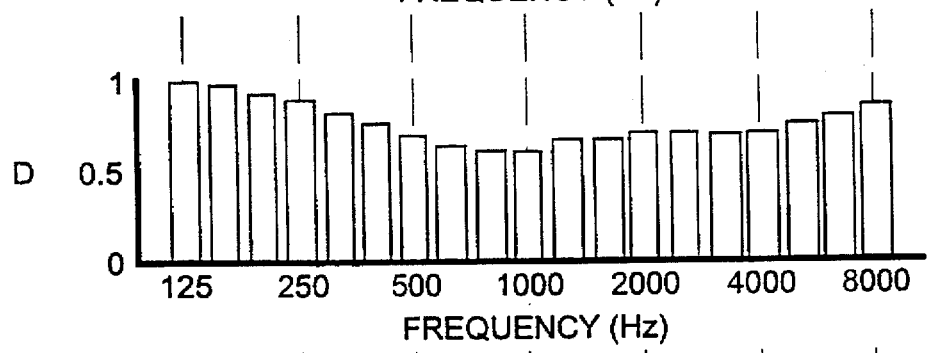

One known method for measuring the intelligibility of speech at a given intensity level in a given listing condition is the Articulation Index (AI). The calculation of the AI is derived from empirical measurement of speech recognition performance, and is codified in ANSI standard S3.5, "American National Standards methods for the calculation of the Articulation Index," 1969, and a 1993 draft standard V3.1, "American National Standards methods for the calculation of the Speech Intelligibility Index," both available from the American National Standards Institute, New York, and incorporated herein by reference. The calculation is described in FIGS. 1*a*–1*f*. FIG. 1*a* is an audiogram plot 100, plotting speech intensity level against frequency. (As is common in audiograms, intensity level increases toward the bottom of the graph.) Circles 102 and connecting lines 104 show the threshold hearing loss values for the listener. Bars 106 show the intensity level of the speech, assumed to have a 30 dB dynamic range at each measured frequency. This speech spectrum is taken from the CID (Central Institute for the Deaf) Auditory Test W-22. The bars 110 of FIG. 1*b* show the proportion $W_i$ of the corresponding bar 106 that exceeds the hearing loss threshold 102, 104. The AI calculation also reduces bars would be the proportion of the speech dynamic range that exceeds background noise. FIG. 1*c* shows a frequency importance function I 120 that characterizes the importance to speech intelligibility of each frequency band. This importance function is also taken from the CID W-22 test. For instance, it is seen (bar 122) that the frequencies around 2000 Hz are the most important in conveying intelligible speech, and that frequencies above 8000 Hz convey minimal speech information. FIG. 1*d* plots a distortion function $D_i$ against intensity level for a specific frequency. The specific distortion function will vary with frequency and the intensity level of the speech, and accounts for the observation that as speech intensity level increases, distortion (for instance, in the cochlea) reduces intelligibility. FIG. 1*e* plots the value of the distortion function for each frequency, evaluated for the speech intensity levels of FIG. 1*a*. (Computation of the distortion term involves measuring properties of the speech and of the listener, and is more fully described in the ANSI standard.)

The AI is calculated from the values plotted in FIGS. 1*a*–1*e*:

$$AI = \sum_{i \in \text{frequency}} I_i W_i D_i \tag{1}$$

Figure 1F:
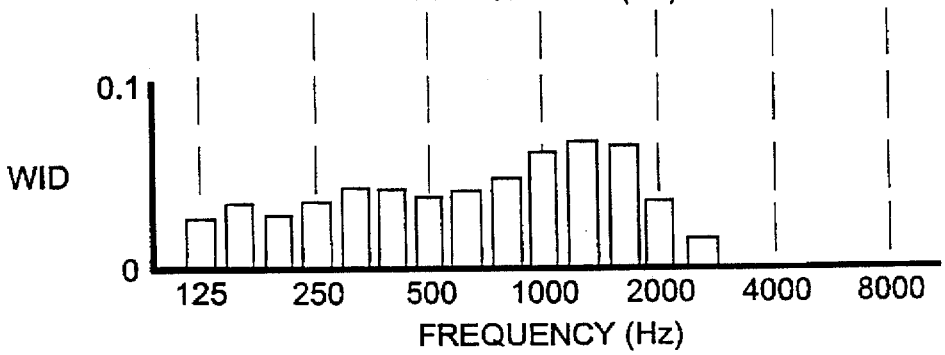

FIG. 1*f* plots the constituent products $W_i \times I_i \times D_i$ for each frequency band.

The sum of the bars in FIG. 1*f* is 0.55, the AI for the speech and hearing loss of FIG. 1*a*. Values of AI range between 0.0 and 1.0.

FIG. 2*a* plots the value of the AI against speech intensity level in quiet-background listening conditions, for normal hearing. As speech intensity level increases, the AI—and thus, the intelligibility of the speech—increases as more of the dynamic range of the speech emerges above the hearing threshold of a normal listener, up to a maximum at about 55 dB at point 202. As intensity level continues to increase, distortion decreases the intelligibility of the speech and thus the AI decreases. The AI curve has a similar increasing-then-decreasing shape when plotted against speech intensity level in other listening conditions.

FIG. 2*b* plots speech intelligibility performance, as measured by a standardized audiometry speech test, against AI value. Note that as AI value increases, intelligibility increases, until the AI reaches about 0.5 at point 212, when recognition asymptotes at the near-100% speech recognition level.

FIG. 2*c* plots AI against intensity level for an ear with the hearing loss of FIG. 1*a*. Note that the maximum AI 212 is somewhat less than 1.0, and is achieved at a somewhat higher speech intensity level than in the normal hearing plot of FIG. 2*a*.

Figure 2D:
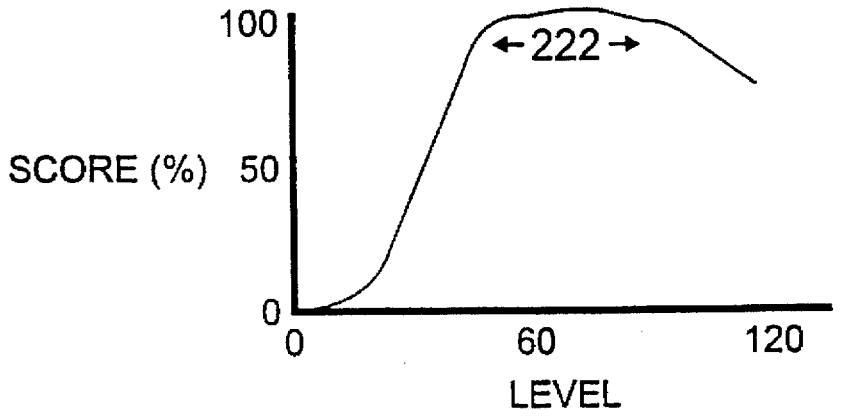
FIG. 2*d* is a graph that plots speech recognition score as a function of speech intensity level.

FIG. 2*d* combines FIGS. 2*b* and 2*c* to plot speech recognition against speech intensity level with a quiet background, for the impaired ear of FIG. 1*a*. Note that near-100% recognition is achieved, though for a more-limited range 212 of intensity levels than for the normal ear of FIG. 2*b*.

The Integrated Articulation Index (IAI)

Figure 3:
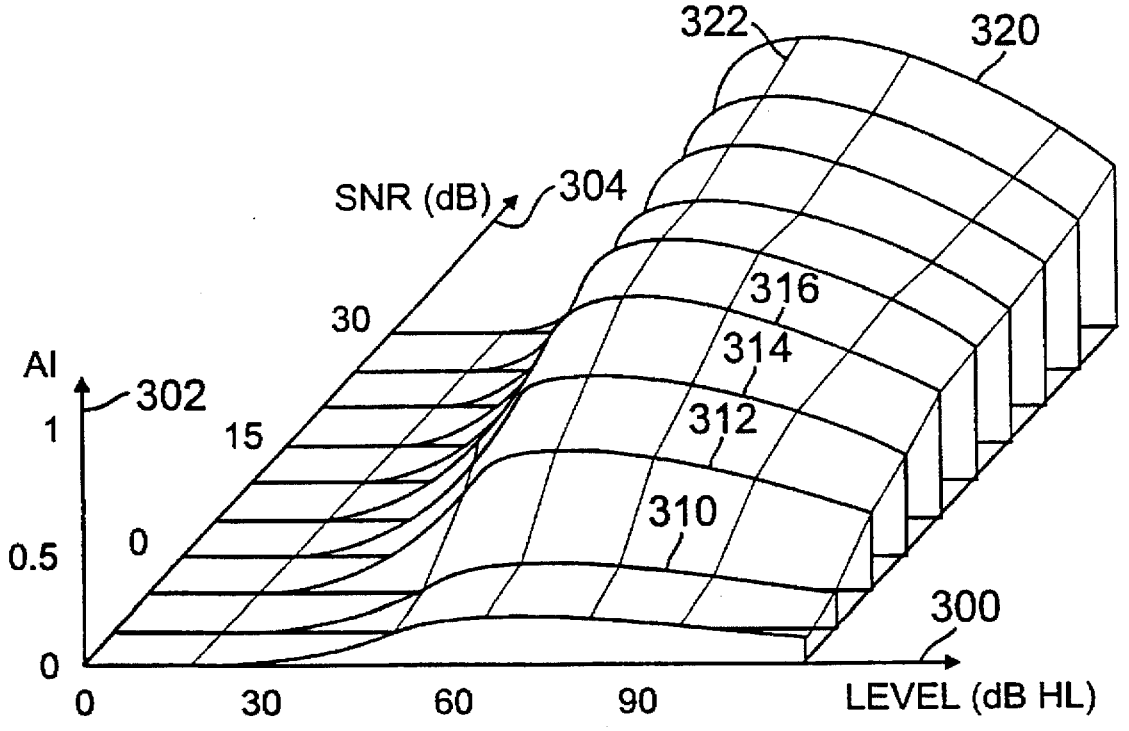
FIG. 3 is a graph that plots AI as a function of speech intensity level and signal-to-noise ratio.

Referring to FIG. 3, a particularly useful calculation for the Integrated Articulation Index (IAI) is $$\sum_{k \in SNR} \sum_{j \in level} AI_{j,k} \times w_{j,k} \tag{2}$$

for discrete values of intensity level and signal-to-noise ratio (SNR), or $$\int_{SNR} \int_{level} AI(level, SNR) \times w(level, SNR) \tag{3}$$

for continuous ranges of intensity level and SNR. The two summations are over the range of SNR's and speech intensity levels of interest to the listener, AIj,k are the Articulation Index (AI) values calculated for the listener in the respective noise and SNR listening condition, and wi,j are importance weights assigned to each condition. In FIG. 3, the horizontal axis 300 is speech intensity level, and the vertical axis 302 is AI, as in FIG. 2. The axis 304 into the paper is SNR. At each value of SNR, the AI curve 310, 312, 314 has an increasing-then-decreasing shape similar to that of FIG. 2. Indeed, as SNR approaches the quiet limiting case, the AI curve 320 approaches that of FIG. 2*a*. The IAI is seen to be the volume under the surface of FIG. 3, the double integral of equation (3). The effect of the weights is not shown in the integration of FIG. 3.

The IAI can be used to compare hearing aid prescriptions against each other. The IAI can be used to choose the prescription that will have the most benefit for the patient, or to determine the conditions under which the hearing aid should switch from one frequency response characteristic to another.

Figure 4:
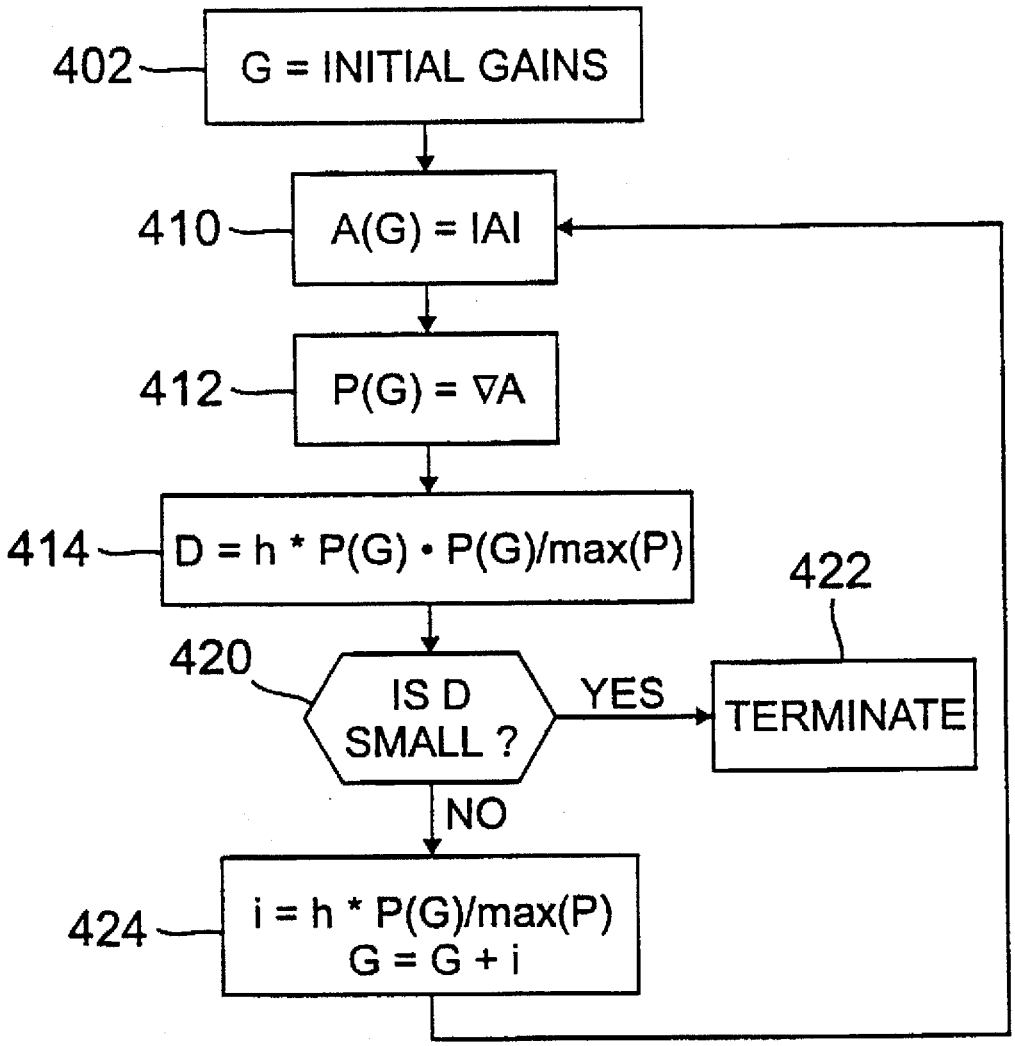
FIG. 4 is a flow-chart of a method for optimizing Integrated AI.
Figure 10:
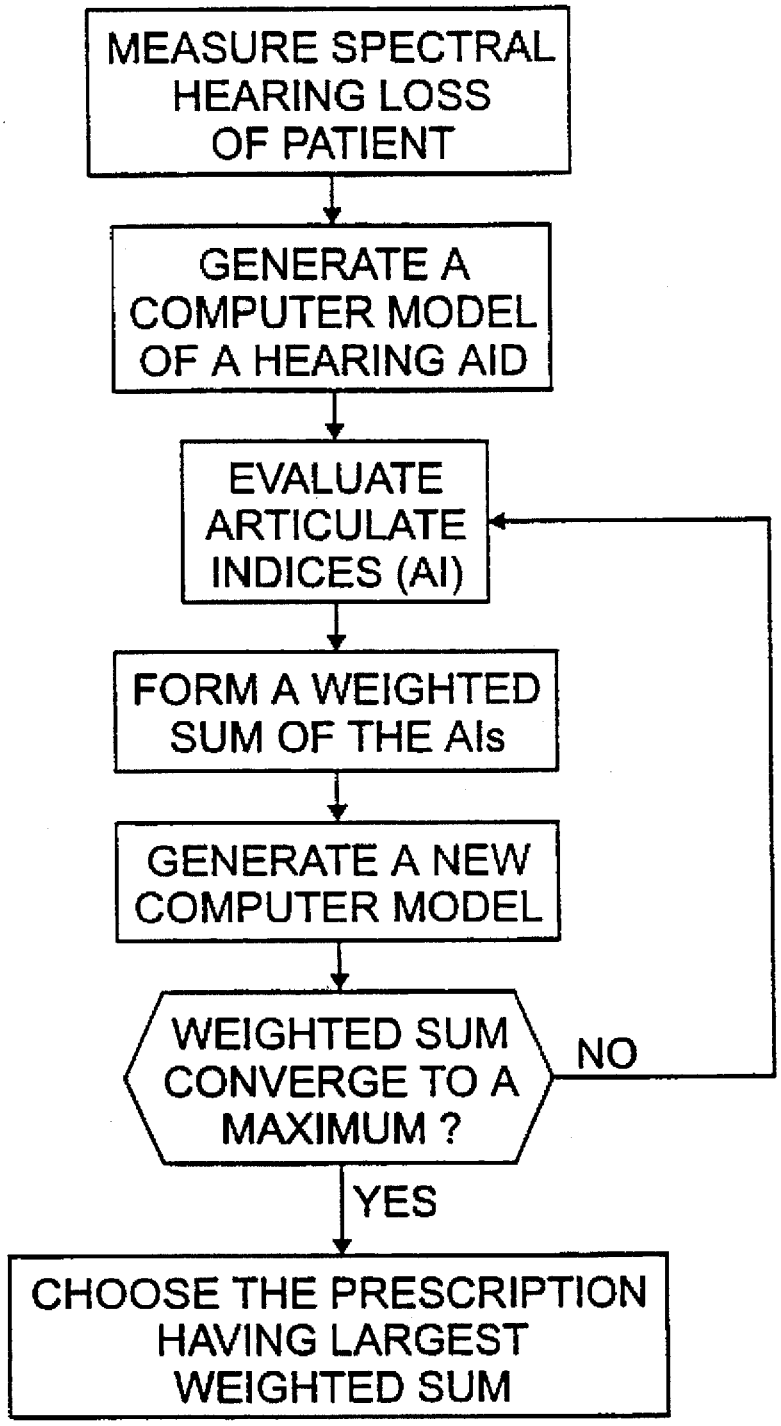
FIG. 10 is a flow-chart for a method of determining a hearing aid prescription for a patient.

A method of determining a hearing aid prescription for a patient is shown in FIG. 10. More specifically, referring to FIG. 4, not only can the IAI be used to compare "real" hearing aids to each other, the IAI can be used as a maximization criterion in a computer-model search of theoretical hearing aid prescriptions to find the best fit to the patient's hearing loss. Conceptually, the method of FIG. 4 treats possible hearing aid gain curves as an independent variable, and the IAI evaluated for each of those gain curves as a dependent variable, and searches through possible hearing aid gain curves to find the maximum IAI. The gain curves may be represented, for instance, as a vector of eighteen ⅓-octave gains for the frequencies between 125 Hz and 8 KHz. In FIG. 4, "G" is a hearing aid gain curve, and "A(G)" is the IAI for hearing aid gain curve G. In step 410, an initial gain curve is selected, for instance using a known method of determining a hearing aid gain curve. In step 410, the IAI for the current gain curve G is calculated, and stored in a variable A(G). In step 412, the neighborhood gradient of A is computed:

$$P(G) = \nabla A(G) = \left\{ \frac{\partial A}{\partial g_1} dg_1, \frac{\partial A}{\partial g_2} dg_2, \ldots, \frac{\partial A}{\partial g_{18}} dg_{18} \right\}$$

where the gradient components $(\partial A/\partial g_n)\, dg_n$ are estimated as finite differences by adjusting each frequency gain, one at a time, by a step of 2 dB. The neighborhood gradient is stored in a variable P(G). The gradient is a vector that points in the direction of fastest increase in A. In step 414, a value is computed that corresponds to the slope of the IAI in the neighborhood of G, telling whether there is significant improvement still to be obtained by further tuning of G. In step 420, the method tests whether D is "small," that is, whether the method has converged on G whose associated IAI is essentially as good as any IAI, and thus the corresponding hearing aid, can be. A threshold value for D of 0.0002 has been found to give good results. If D is small, then the method terminates in step 422. In step 424, the method selects a new G gain curve value to test in the next iteration of the method. h is an arbitrary scaling factor. A value of h=2 dB has been found to work well.

The invention provides a method of objectively quantifying the benefit to the listener of a given hearing aid, taking into account the various listening conditions in which the listener lives. By quantifying the benefit of multiple possible hearing aid prescriptions and comparing them to each other, the computer modelling process of FIG. 4 can prescribe a hearing aid that benefits the patient in many listening conditions.

FIGS. 5*a*–5*l* compare three hearing aid prescriptions for a given patient, two determined by known means and the optimum prescription determined by the invention and the method of FIG. 4.

Figure 5A:
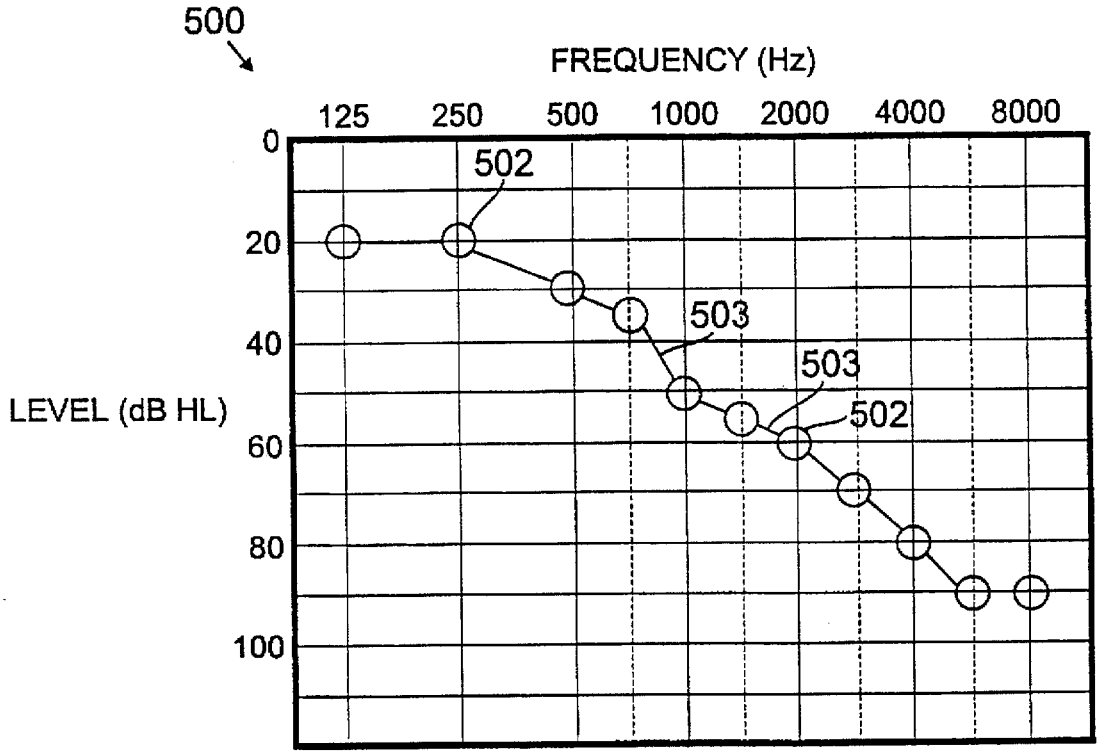
FIG. 5*a* is a patient audiogram showing a high-frequency hearing loss.

FIG. 5*a* shows the patient's audiogram 500 with circles 502 indicating the patient's hearing loss at ½-octave frequencies. Following steps in the method, for instance the calculation of the ANSI Articulation Index and the optimization of FIG. 4, may assume that the audiogram was measured at ⅓-octave frequencies. Hearing loss values between measured frequencies can be interpolated from the measured values, for instance using linear interpolation as shown by lines 503.

Figure 5B:
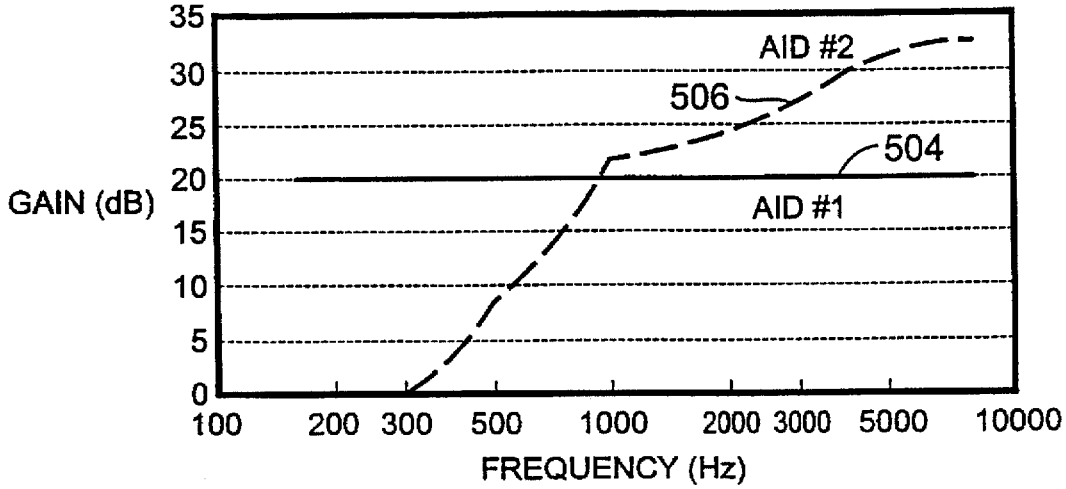
FIG. 5*b* is a graph that plots frequency response of two hearing aids.

FIG. 5*b* shows two hearing aid gain curves: solid curve 504 shows a flat 20 dB gain, and dashed curve 506 shows the prescription determined by the known NAL method (Byrne and Dillon: "The National Acoustic Laboratories (NAL) new procedure for selecting the gain and frequency response of a hearing aid," Ear Hear 1986:7:257–265).

Figure 5C:
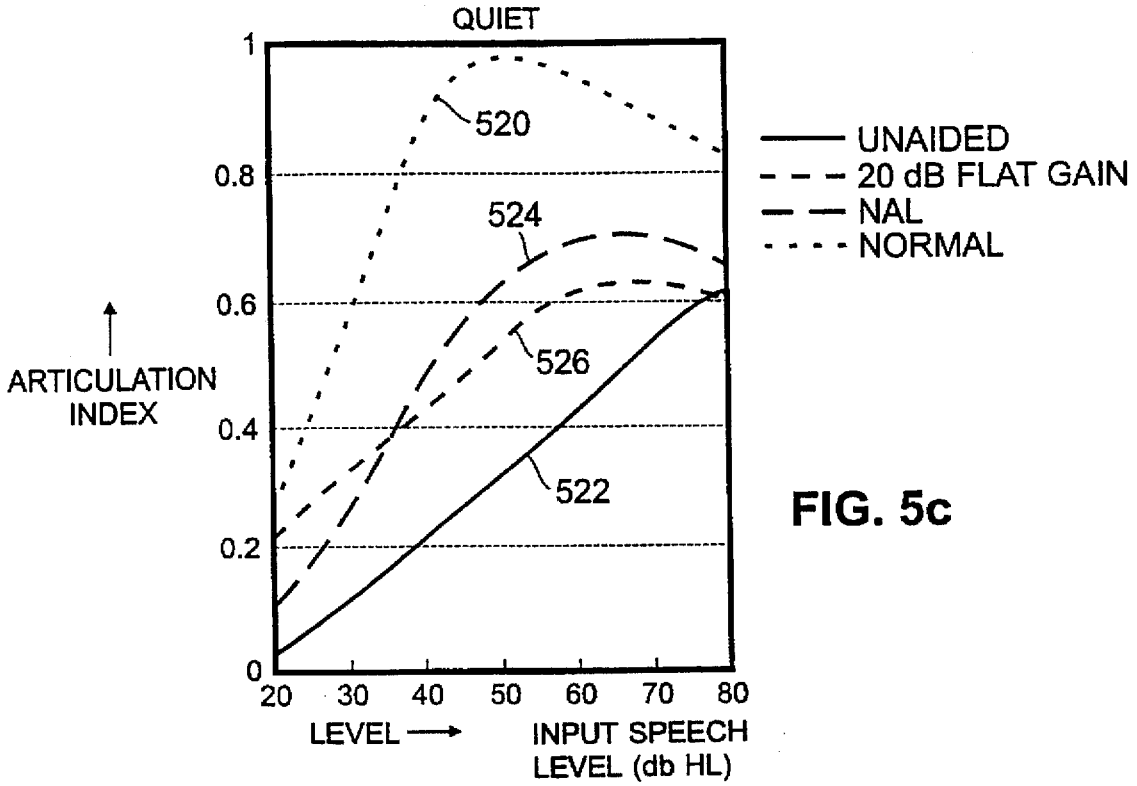
FIGS. 5*c*–5*h* are graphs that plot AI as a function of speech intensity level.
Figure 5D:
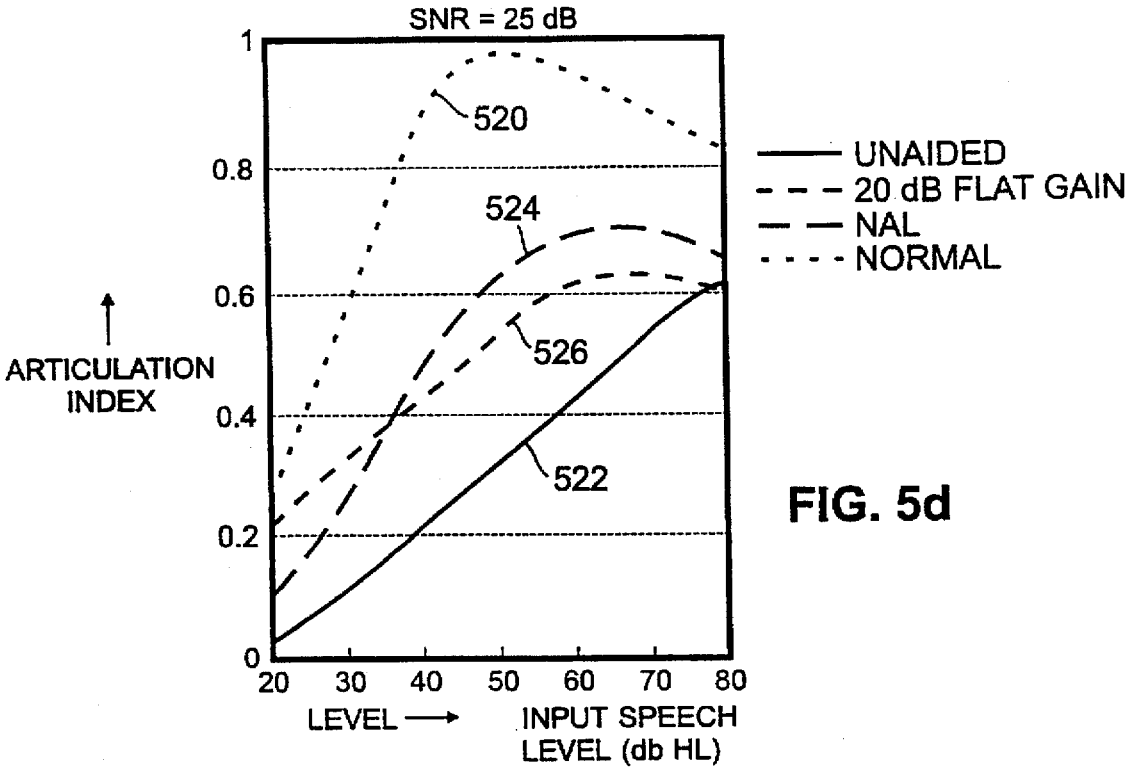
Figure 5E:
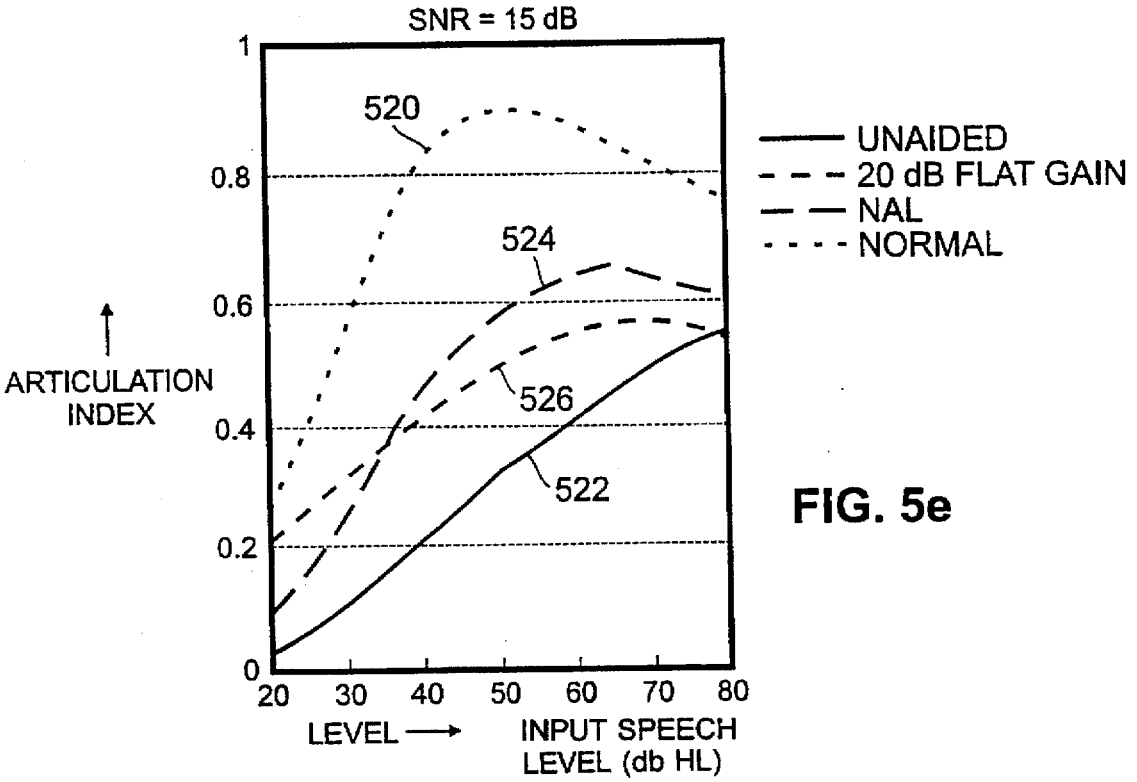
Figure 5F:
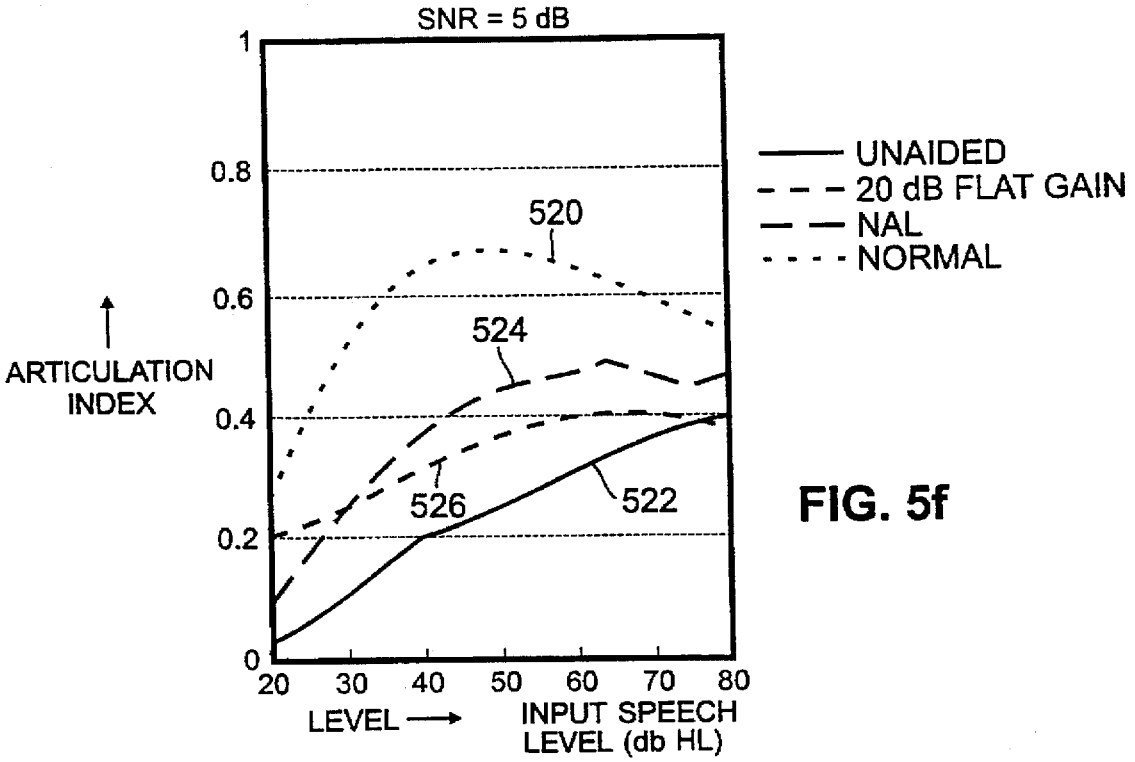
Figure 5G:
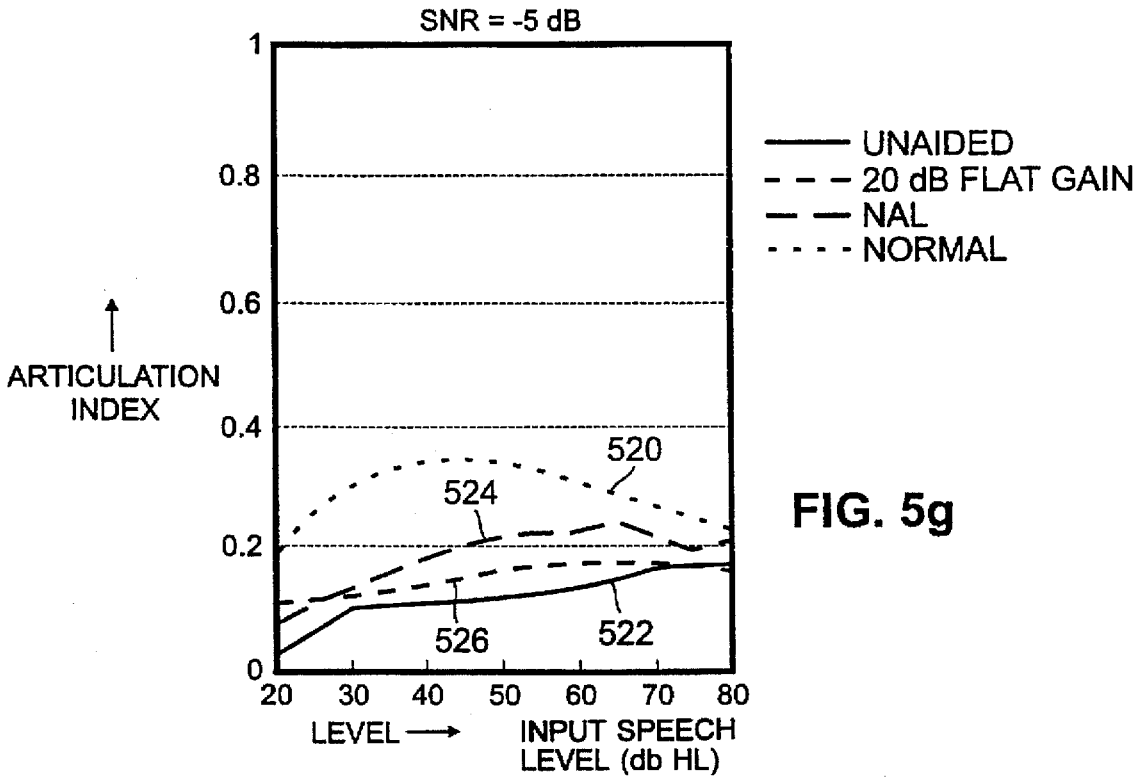
Figure 5H:
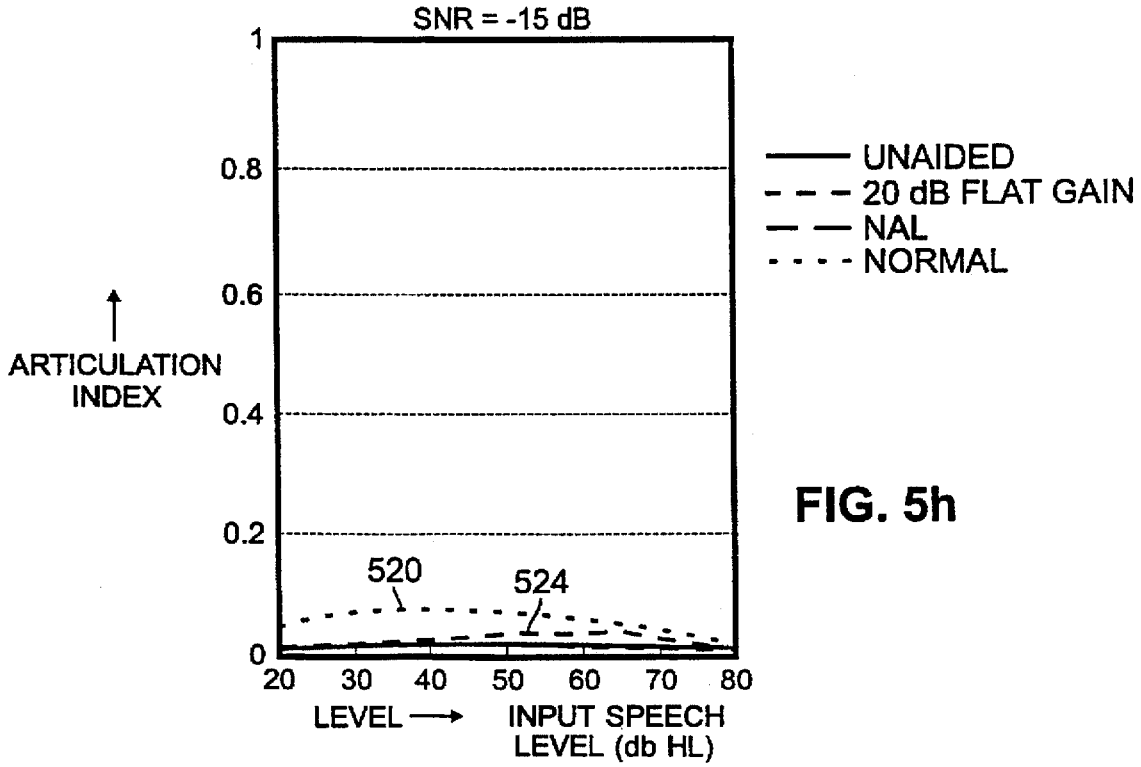

FIGS. 5*c*–5*h* plot Articulation Index (AI) against speech intensity level for each of six signal-to-noise ratios for each of a normal ear, the unaided ear of FIG. 5*a*, and the two known hearing aid prescriptions of FIG. 5*b*. FIG. 5*c* shows AI in quiet (infinite signal-to-noise ratio), and FIGS. 5*d*–5*h* show AI for 25 dB, 15 dB, 5 dB, −5 dB, and −15 dB, respectively. In each of these figures, dotted line 520 shows the AI for normal hearing, solid line 522 shows the AI for the unaided ear of FIG. 5*a*, longer-dashed line 524 shows the AI for the ear corrected with the NAL hearing aid, and shorter-dashed line 526 shows the AI for the 20 dB flat gain hearing aid.

Figure 5I:
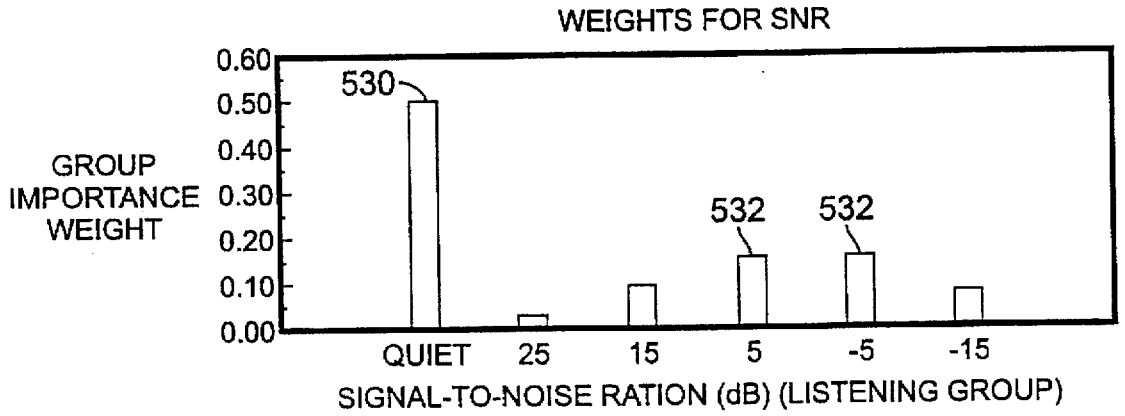
FIGS. 5*i*–5*j* are bar graphs of weights used in calculating an Integrated AI.
Figure 5J:
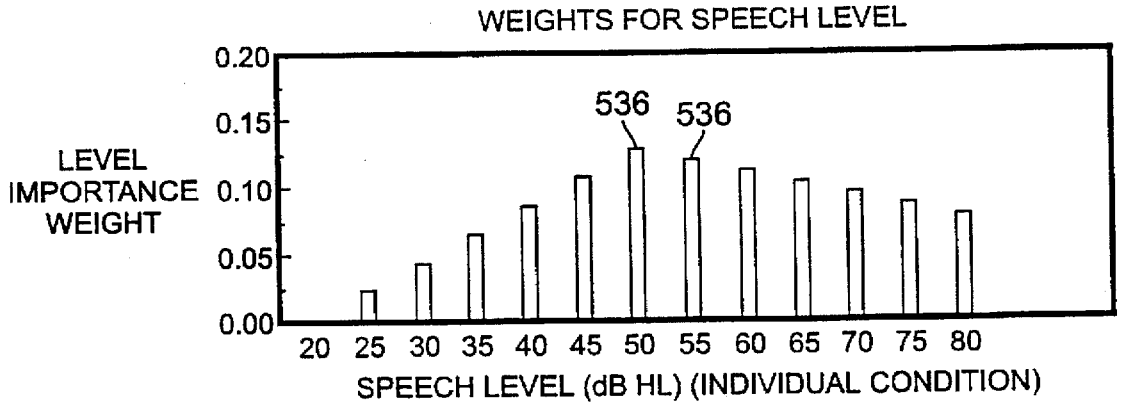

FIG. 5*i* and FIG. 5*j* show importance weights that are assigned to the patient's listening conditions. FIG. 5*i* shows that quiet 530 and ±5 dB signal-to-noise ratio (SNR) 532 listening conditions are given higher weights than other SNR conditions, indicating that quiet listening conditions are of primary importance to the patient, and ±5 dB SNR conditions are of secondary importance. FIG. 5*j* shows that speech intensity levels near 50 dB are given larger weights 536 than louder or softer intensity levels.

The weights for different listening conditions could be tailored to a specific patient as a result of a patient interview, derived from theory, or chosen for one or more "generic" patient profiles as a result of studies. For example, one group of listening conditions might be multi-talker noise for a range of intensity levels, and mid-range intensities might be assigned greater weights on the basis that a particular patient works in an environment with moderate background noise levels. Higher weights are given to specific listening conditions where the patient spends the most time, or to listening conditions most socially important to the patient.

The weights should be chosen so that they add to unity:

$$\sum_{k \in SNR} \sum_{j \in level} w_{j,k} = 1 \quad (4)$$

so that IAI values calculated for different patients with different sets of weights can be compared to each other. The weights for individual values of intensity level and SNR can be chosen as the product of the marginal level and SNR weights (if both sets of marginal weights sum to unity, then the sum of the product weights will also sum to unity), or may be chosen independently of the marginal weights.

Figure 5L:
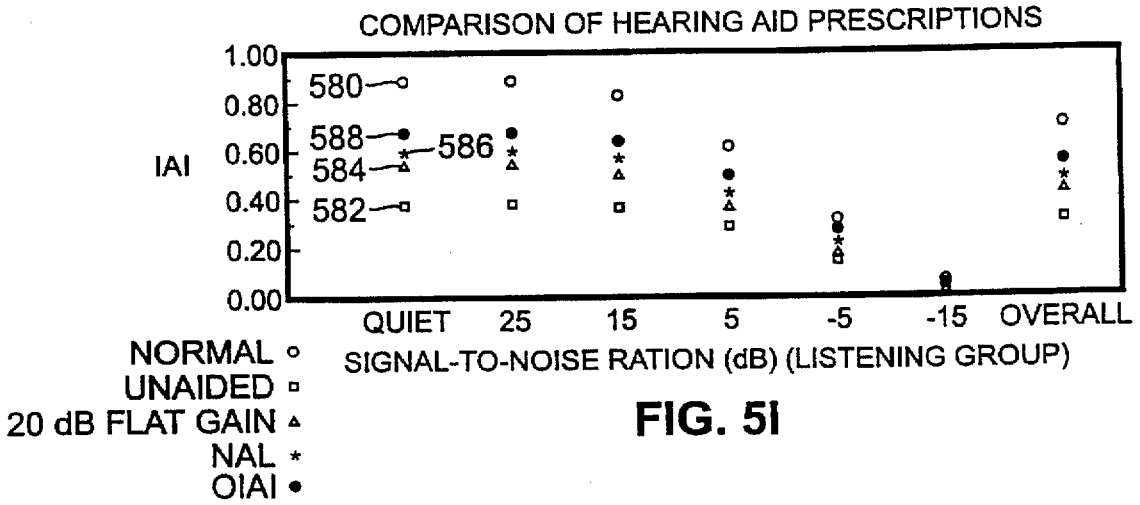
FIG. 5*l* is a graph that plots Integrated AI as a function of signal-to-noise ratio.
Figure 5K:
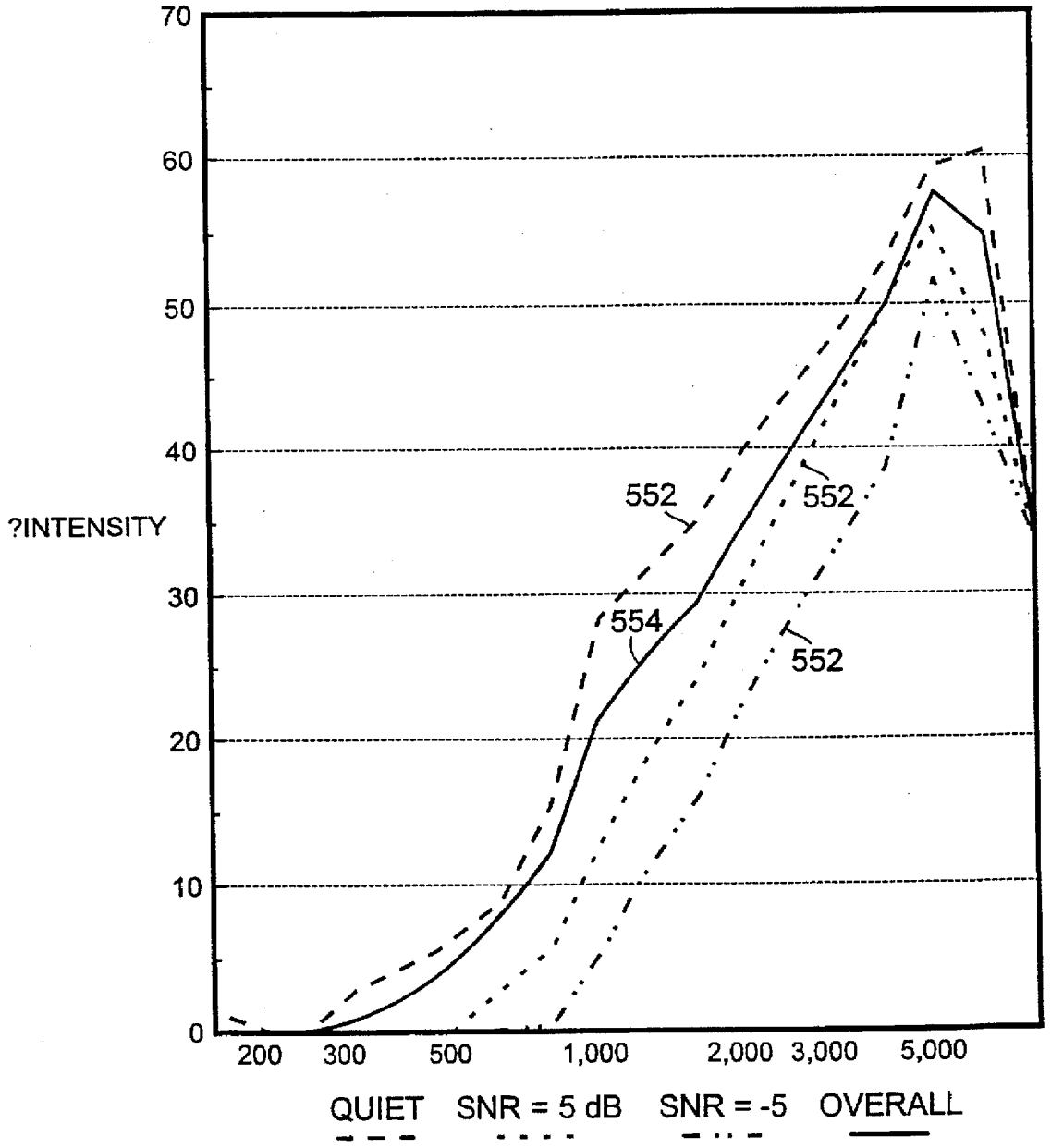
FIG. 5*k* is a graph that plots frequency response of four hearing aids.

FIG. 5*k* shows hearing gain characteristics computed for different listening conditions using the method of FIG. 4. The three broken curves 552 show hearing aid gain curves optimized for each of three SNR's, and solid curve 554 shows the gain curve chosen by the method of FIG. 4 to optimize across the other three SNR's. If the hearing aid's gain is static, it would be chosen to have gain 554. If the hearing aid adapts to different SNR's, it would jump among the other three gain curves.

FIG. 5*l* compares the intelligibility of speech as heard by a normal ear, an unaided impaired ear, and the impaired ear aided by hearing aids of three different prescriptions. The horizontal axis shows multiple SNR's, ranging from quiet to −15 dB, with a right-most column showing an overall score integrated over the other six SNR's. The vertical axis shows the value of Integrated Articulation Index (IAI) for each SNR. Circles 580 plot the IAI for a normal listener. Squares 582 plot the IAI for the unaided ear of FIG. 5*a*. Triangles 584 plot IAI for the 20 dB flat-gain hearing aid of FIG. 5*b*, and stars 586 plot IAI for the NAL hearing aid of FIG. 5*b*. Solid dots 588 plot the IAI for the Optimized Integrated Articulation Index (OIAI) hearing aid, calculated using the optimization method of FIG. 4.

Figure 6:
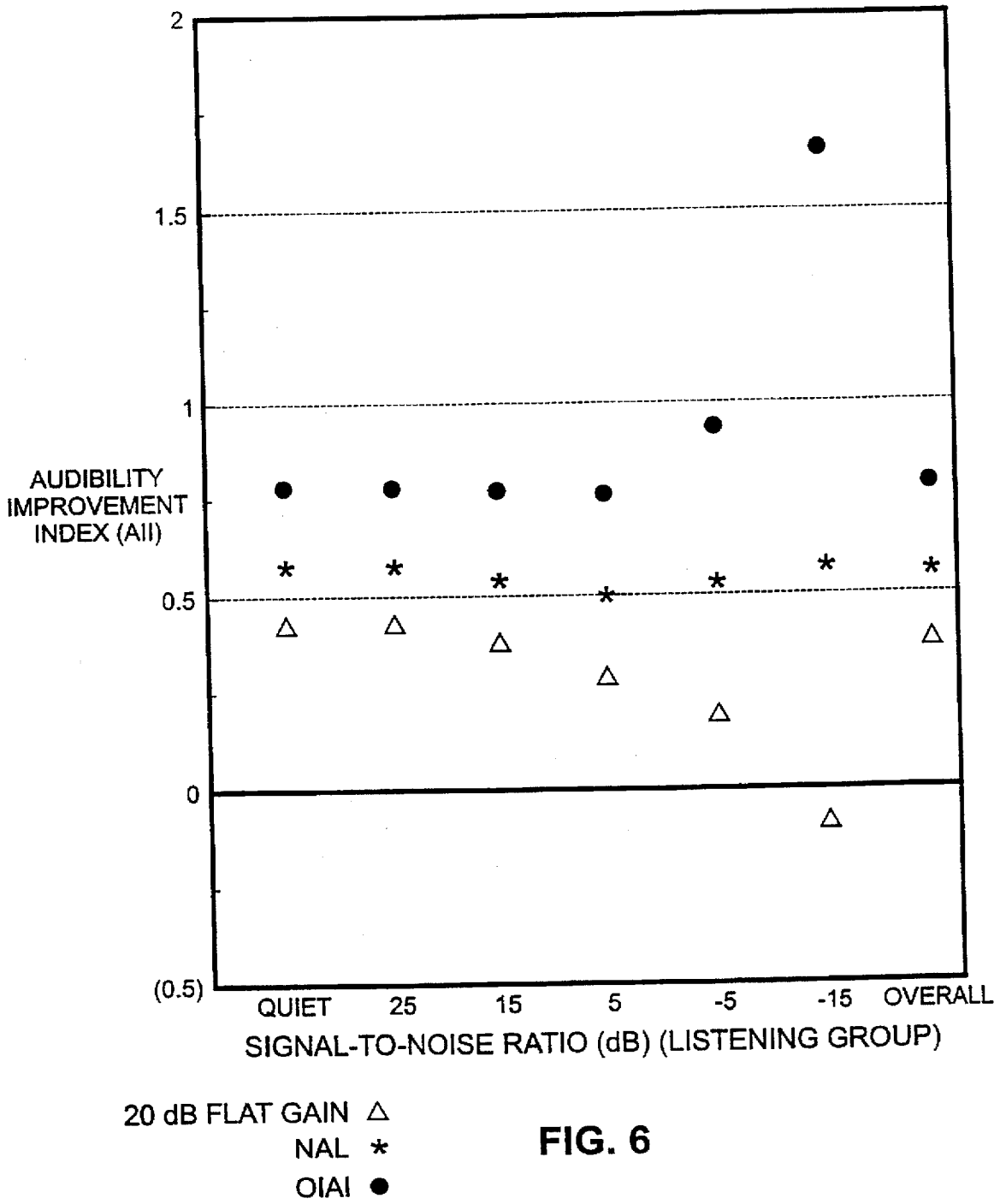
FIG. 6 is a graphs that plots Audibility Improvement Index as a function of signal-to-noise ratio.

FIG. 6 shows an Audibility Improvement Index (AII) used to evaluate the benefit of a specific hearing aid under specific signal noise conditions. It may be found that patients are generally dissatisfied with even the best possible hearing aid, or that its cost and inconvenience is not warranted, unless the hearing aid improves intelligibility by a threshold amount. The AII is calculated as $$\frac{\text{aided } IAI - \text{unaided } IAI}{\text{unaided } IAI} \quad (5)$$

Multiple IAI's of a single hearing aid prescription could be evaluated with different sets of weighting values assigned to the various listening conditions, each set corresponding to a "cluster" of listening conditions. This would provide a comparative evaluation of the hearing aid prescription under differently-weighted sets of listening conditions. The AII could be used to compare the two IAI's. If this AII exceeds a threshold value, the clinician might determine that a single hearing aid prescription could not serve the patient's needs. The result might be a hearing aid with multiple prescription gain curves each tailored to one of the patient's listening conditions, and either an automatic or manual control to switch among the various gain curves, somewhat in the manner of bifocal glasses.

Similarly, the IAI of a patient (with aided or unaided hearing) could be evaluated with different sets of weighting values, and the AII of these IAI's computed. This might assist in matching the listening conditions to the patient. For instance, the patient might be moved from a job whose listening conditions evaluate to a low IAI to another job whose listening conditions evaluate to a higher IAI. The AII between the IAI's for these jobs might be used to determine a cost/benefit ratio of job retraining.

Figure 7:
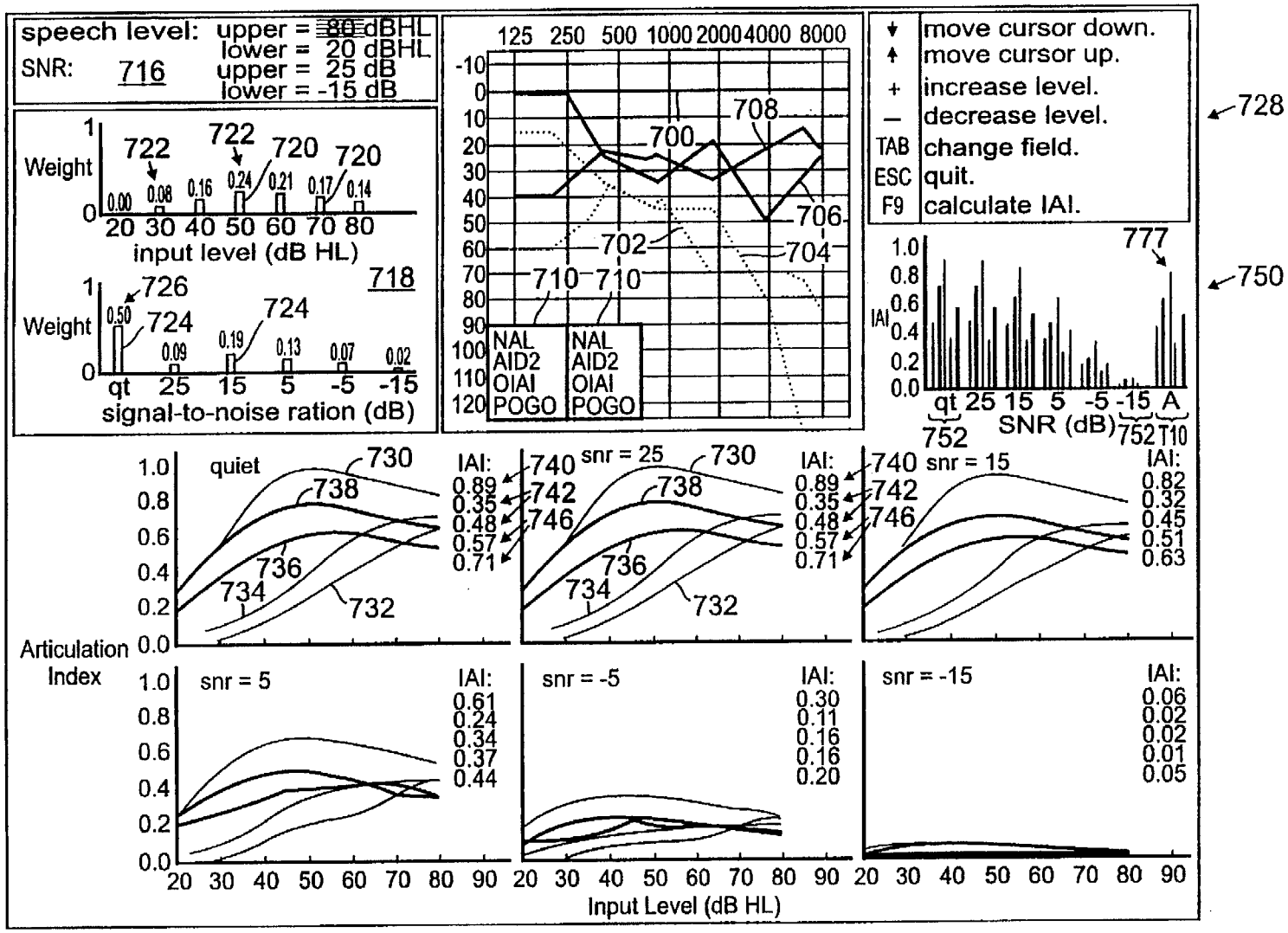
FIG. 7 is a computer screen display showing AI's under multiple conditions, and the integrals of those AI's.

FIG. 7 shows a screen display of a computer program that uses the IAI in prescribing a hearing aid for a patient.

The top center panel of FIG. 7 shows an audiogram. Curve 700 shows normal hearing level. Curves 702 and 704 plot the unaided hearing loss of the patient's left and right ears, respectively. Pick list 710 gives the clinician a menu of different hearing aid prescriptions, one for the left ear and one for the right. Curves 706 and 708 plot the frequency gains for the chosen hearing aid.

The two upper left panels 716,718 of FIG. 7 allow the clinician to select ranges of listening conditions to be considered, and weights for conditions within those ranges. Panel 716 allows the independent selection of upper and lower limits for intensity level and SNR. The selected ranges are divided into seven intensities and six SNR's. Panel 718 shows weighting bars 720 for the seven intensity levels and weighting bars 724 for the six SNR's within the selected ranges. The clinician can pick an individual weighting bar 720 or 724 and increase or decrease the weight, for instance by pressing the "+" or "−" key (menu 728 at the top right of the figure). The software will automatically adjust the value 722,726 at the top of the bar and recalculate the other weights to maintain a unity sum.

Each of the six bottom panels of FIG. 7 plots Articulation Index (AI) against intensity level for the six SNR listening conditions of the upper left panel, respectively. Curves 732 and 734 plot AI for the unaided ears of curves 702 and 704. Curves 736 and 738 plot AI for the aided ears of curves 706 and 708. In the top right corner of each of the six panels are displayed five Integrated Articulation Indices (IAI's). The top Integrated AI 740 integrates the area under the normal hearing curve 730, weighted by the weights of the top left panel. The next two IAI's 742 integrate the weighted areas under the two unaided ear curves 732,734. And the last two IAI's 746 integrate the weighted areas under the aided curves 736, 738.

At the right of FIG. 7, and near the top, are a series 750 of bars plotting IAI. Each group of five bars 752 corresponds to one of the six listening condition plots at the bottom of the screen, plus an overall "integrated listening condition." The five bars in each group 752 correspond to the five IAI's 730–738 displayed in the corresponding graph. From left to right, the five bars of each group 752 show Integrated AI for unaided left, aided left, normal, unaided right, and aided right ears. The right-most group 770 shows the Integrated Articulation Indices integrated across both SNR and intensity level. Thus, the center bar 777 in group "A" is the figure of merit for the hearing aid currently selected in pick list 710. The hearing aid that best suits the patient described in the audiogram at the top center and the weights at the top left will be the hearing aid that maximizes the height of bar 777.

FIG. 8 shows a diagnostic and summary chart printed by the software. In the upper right, an audiogram plots left ear hearing loss 802 and right ear hearing loss 804 against frequency. From the audiogram data, predicted speech intelligibility scores are calculated and plotted in the upper left graph. The upper left graph plots normal speech intelligibility score 810 against speech intensity level, with the left ear predicted score 812 and right ear predicted score 814. Also in the upper left graph, actual word recognition scores for the left ear 816 and right ear 818 are plotted with 95% confidence level bars. The fact that bars 818 lie so far off predicted curve 814 indicates that the patient likely has a non-threshold loss, for instance a tumor interfering with the auditory nerve.

Comparison with known methods for deriving a hearing aid prescription

FIGS. 9a–9d compare a hearing aid prescription determined by the optimization method of FIG. 4 to hearing aid prescriptions determined by the known POGO ("Prescription of gain/output for hearing aids", McCandless & Lyregaard, Hear Instr 1983;35:16–21) and NAL methods. The three hearing aids are considered under two groups of listening conditions, quiet and noise.

The quiet setting is defined as a group of input speech levels (in 1 dB steps) from 30 to 90 dB HL (50 to 110 dB SPL). All individual input levels are assumed to be equally important to the overall performance. The importance weight is 1/61 at each level, thus the sum of the weights at all levels is equal to one. The noise setting used in this study consists of both speech and noise with input speech level ranging from 30 dB HL to 90 dB HL (in 1 dB steps) and a constant signal-to-noise ratio (SNR) of −3 dB. The noise spectrum has a shape similar to the speech spectrum having equal energy from 250 to 1000 Hz an a 12 dB per octave roll-off from 1000 to 6000 Hz. All input levels are assumed to be equally important to the overall performance, with an importance weight of 1/61 at each. The upper limit (clipping level) of the hearing aid is assumed to be 125 dB SPL at all frequencies. The audiogram used for the evaluation is that of FIG. 5a, indicating a high-frequency hearing loss having pure tone thresholds of 20, 20, 30, 35, 50, 55, 60, 70, 80, 90, and 90 dB HL at frequencies of 125, 250, 500, 750, 1000, 1500, 2000, 3000, 4000, 6000, and 8000 Hz, respectively.

Figure 9A:
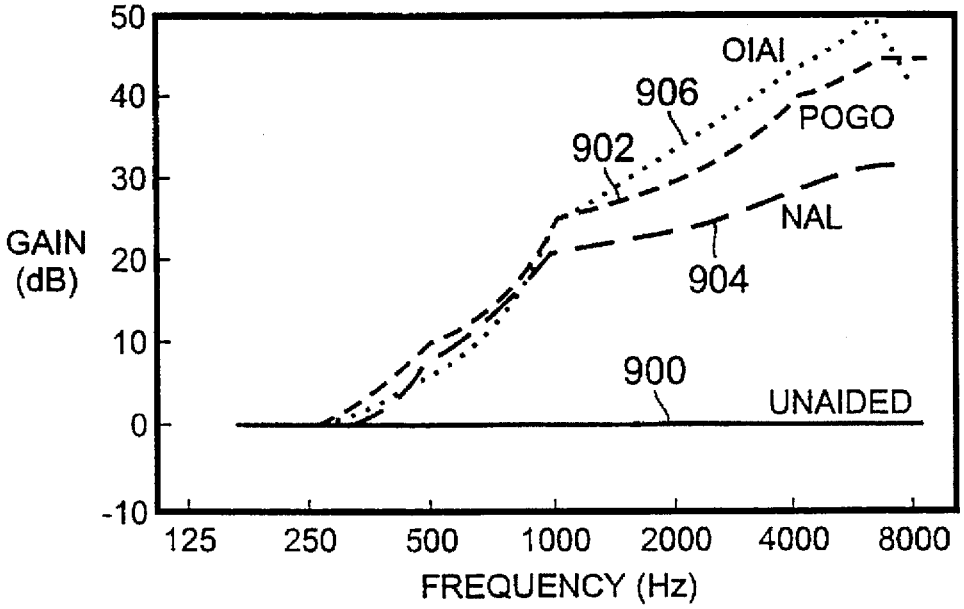
FIGS. 9*a* and 9*c* are graphs that plot frequency response of several hearing aids.
Figure 9B:
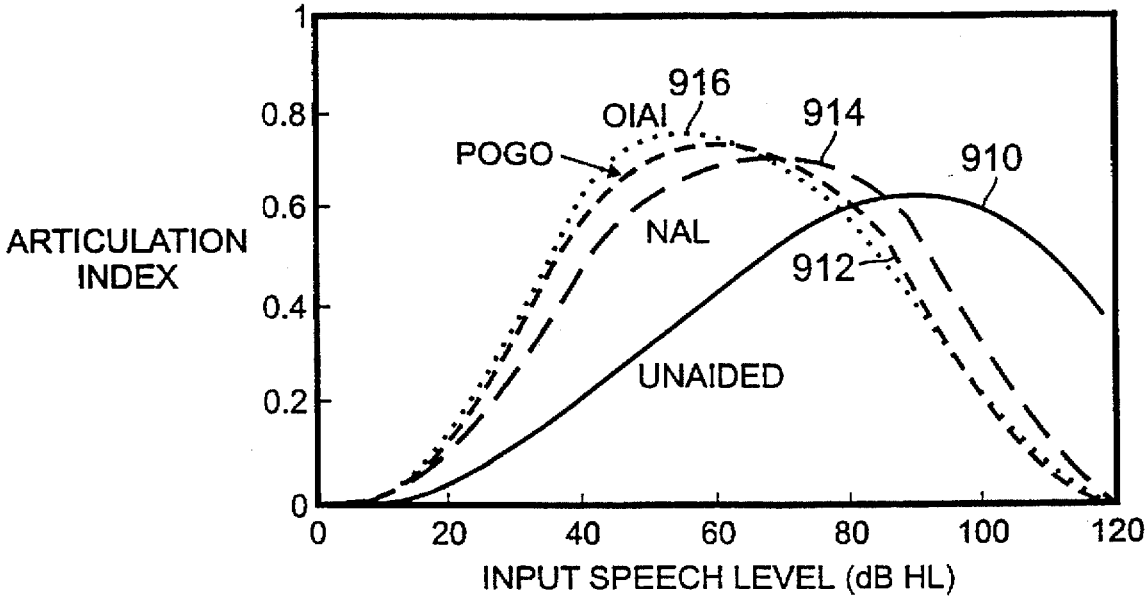
FIGS. 9*b* and 9*d* are graphs that plot AI as a function of speech intensity level.

FIG. 9a shows the frequency gain characteristics for the unaided 900, POGO 902, NAL 904, and OIAI 900 prescriptions for the quiet listening condition group, and FIG. 9b shows the corresponding AI's 900–906 as a function of input level. At low frequencies (below 1000 Hz), the three prescriptions assign similar gains. At higher frequencies (above 1000 Hz), the OIAI prescription 906 assigns slightly greater gains than the other two prescriptions 902,904, except at 8000 Hz where the gain assigned by OIAI is 4 dB less than that prescribed by the POGO prescription 902. The IAI for the input levels from 30 and 90 dB HL (in 1 dB steps) is 0.626 for the OIAI 916 prescription, 0.620 for POGO 912, and 0.593 for NAL 914. The relative difference of the IAI's is only 1% between OIAI and POGO, and 6% between OIAI and NAL. This means that the POGO and NAL procedures are close to maximizing the overall performance in terms of AI's in quiet and that the frequency response based on the OIAI produces a result comparable to that of well-validated procedures.

Figure 9C:
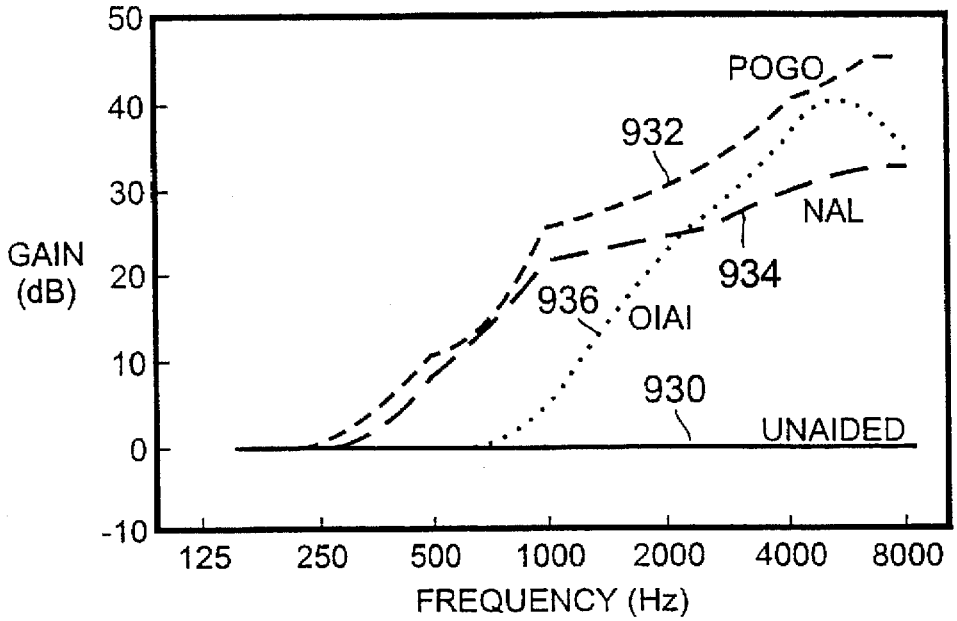
Figure 9D:
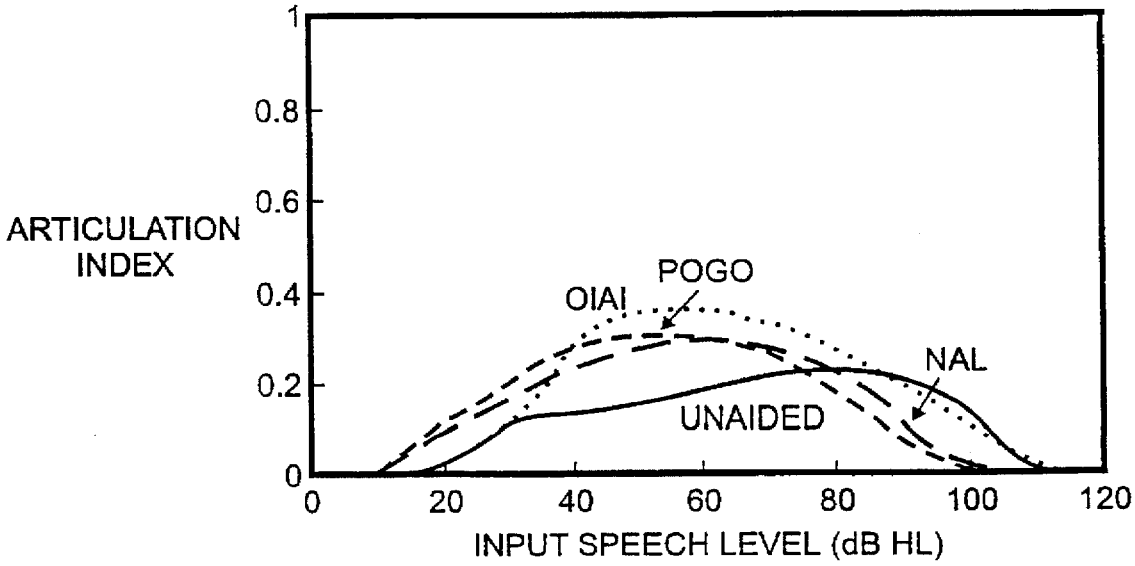

FIG. 9c shows the frequency gain characteristics determined for the noise group of listening conditions, and FIG. 9d shows the corresponding AI's as a function of the speech intensity level. The gains assigned by the POGO 932 and NAL 934 prescriptions are the same as those in the quiet group. The OIAI gains 936 are different, however. OIAI prescribes no gain for frequencies below 700 Hz. The OIAI frequency-gain slope 936 is steeper than those for the POGO 932 and NAL 934 prescriptions for the frequencies between 700 and 4000 Hz. Above 4000 Hz, OIAI assigns smaller gains. FIG. 9d shows that the IAI is 0.266 for the OIAI prescription, 0.244 for POGO, and 0.234 for NAL. The relative difference of the IAI's is 9% between the OIAI and POGO prescriptions, and 14% between the OIAI and NAL prescriptions. In other words, the hearing aid with frequency-gain assigned by the OIAI procedure will transmit 9 and 14% more speech audibility information than those assigned by the POGO and NAL procedures, respectively.

For the quiet group of listening conditions, the frequency-gain characteristics of a hearing aid assigned by the OIAI 906 procedure are similar to those prescribed by the POGO 902 and NAL 904 procedures, and the IAI is about the same for all three prescriptions. This indicates that the POGO and NAL procedures are close to maximizing the overall performance in a quiet situation, a conclusion similar to that reported by Humes ("An evaluation of several rationales for selecting hearing aid gain," J. Speech Hear Disord 1986;272–281). This is probably the reason why the POGO and NAL procedures are widely accepted. In the noise group of listening conditions, however, the differences among the different prescriptions are greater. Because the upward spread of noise masking is greater than the downward spread of the masking, the lower gains at low frequencies reduce the upward spread of masking, and result in greater audibility at high frequencies, as measured by the greater IAI for the OIAI prescription.

The widely used prescriptive procedures do not address issues regarding the relationship of amplification requirements to the listening conditions, especially noise conditions (Byrne: "Implications of the National Acoustic Laboratories (NAL) research for hearing aid gain and frequency response selection strategies," in Studebaker and Hochberg eds: "Acoustical Factors Affecting Hearing Aid Performance", Boston, Allyn and Bacon, 1993:119–131). The clinical advantage of using the OIAI prescription is that it can assign frequency-gains for a hearing aid according to a patient's primary listening conditions. Because the optimization of frequency gain characteristics are based on the integrated AI for a group of input listening conditions being considered, it is not critical whether a specific listening condition is measurable or not. It is only necessary to estimate the boundary of the listening group, such as possible noise types and possible signal to noise ratios. This feature of the OIAI model has practical value because for most patients the specific listening environments are not measurable and the general types of listening environments may be the only information available to the clinician.

Other embodiments

The ANSI Articulation Index is only one of several base intelligibility calculations that can be used. Other calculation methods for speech intelligibility in a specific listening condition could be used, and then integrated over multiple listening conditions. Another known method for computing speech intelligibility in a single listening condition is the Speech Transmission Index, as described in Steeneken & Houtgast: "A physical method for measuring speech-transmission quality" in J. Acoust Soc Am, 67(1), January. 1980, pp.318–326. Alternately, the Articulation Index calculation, shown in equation (1) above, would be replaced with $$AI' = \sum_{i \in \text{frequency}} I_i W_i D_i X_{1,i} X_{2,i} \ldots X_{n,i} \qquad (6)$$

where the $X_{n,i}$ are other factors for quantifying speech intelligibility, and this AI' would replace the AI term in the sum or integral of equations (2) or (3). One improved Articulation Index includes a factor for distortion, to account for hearing impairment that does not change the threshold of sensitivity to steady tones, the characteristic normally measured in audiograms. Another such factor might quantify deterioration of temporal resolution, with 1 representing normal temporal resolving ability and 0 representing that temporal resolution is totally lost. Another factor for inclusion in an enhanced Articulation Index would account for the limited range of linear operation of a hearing aid. For instance, many hearing aids limit their output power by clipping or compressing signal peaks that exceed certain intensity levels, impairing the clarity of speech being amplified.

Referring again to FIG. 3, integrating the Articulation Index over intensity level and signal-to-noise ratio (SNR) is not the only way to calculate an IAI. Other integration dimensions could be used as well, in some cases coupled with an alternative intelligibility measure as discussed above in connection with equation (6). Simpler IAI's are useful, for instance the single-dimensional IAI obtained by integrating d(level) the area under one of the constant-SNR AI curves 310, 312, 320 of FIG. 3, or integrating d(SNR) the area under constant-level AI curve 322. Intelligibility could be measured for different noise types, for instance steady vs. intermittent noise at the same SNR. AI could be calculated for different voice characteristics, for instance, male vs. female, and the AI values summed. AI could be calculated for different dynamic range compression characteristics, and summed. Various distortion characteristics could be summed. Speech in a variety of reverberation environments could be evaluated for intelligibility, and the resultant values summed.

The IAI can be used to evaluate a number of speech transmission, amplification, and reproduction devices.

The IAI can be used to quantify handicap, for example in a medical-legal evaluation of a patient to determine liability or dames. The IAI could be used to evaluate the expected overall benefit of a surgical procedure designed to improve hearing. This is particularly valuable if the procedure improves audibility of some frequencies and makes others poorer. An evaluation prior to surgery could quantify the expected gain of speech intelligibility to determine a cost/benefit ratio in order to determine whether the surgery should be done.

A hearing aid could adapt itself to the current listening conditions by choosing from among several prescriptions, automatically choosing a prescription that had been determined to be optimal for that particular listening condition. This would be done by partitioning the total range of listening conditions into partitions. For instance, the total SNR range and the total speech intensity level range could be partitioned into three subranges each, for a total of nine listening condition partitions. An optimization method, for instance that of FIG. 4, would be run nine times, once for each partition. During each optimization run, the conditions within a specific partition would be given high weights, and the other conditions would be given low weights. Thus, nine optimized hearing aid gain prescriptions would be computed. When in use, a hearing aid would vary among these nine prescriptions, either stepwise or with smooth real time adjustment.

The Audibility Improvement Index (AII) of FIG. 6 could be used to determine how many different gain curves are useful to provide in an adaptive hearing aid. For instance, the AII could be used to determine whether a fifth adaptive gain curve provided a benefit over an adaptive hearing aid with four curves.

The IAI could be used to evaluate other electro-acoustic transmission systems. For example, the IAI could be used be used to evaluate air traffic control communications where pilots or controllers must hear through different listening intensity levels and with different competing noise signals. The IAI could be used to evaluate how well airplane passengers are going to hear a movie or other cabin announcements, and to select a beneficial amplification gain.

Other embodiments are within the claims.

What is claimed is:

1. A method for selecting an acoustic device for an individual, said method comprising the steps of:

(a) obtaining intelligibility measurements for speech signals transmitted from or reproduced by each of a plurality of devices under a plurality of listening conditions;

(b) forming a weighted sum of said intelligibility measurements for each device;

(c) comparing said weighted sums; and (d) selecting the device with the largest corresponding weighted sum, said device being the best suited to said individual under said plurality of listening conditions.

2. The method of claim 1, wherein:

at least one of said plurality of acoustic devices is a computer model of a real acoustic device.

3. The method of claim 2, further comprising the steps of:

iteratively generating a plurality of said computer models, evaluating the weighted sums corresponding to said computer models, and altering modelled acoustic properties of successive ones of said computer models to increase said weighted sum.

4. The method of claim 3 wherein:

said plurality of acoustic devices includes multiple hearing aid prescriptions to be incorporated into a single adaptive hearing aid configured to selectively switch among said multiple prescriptions.

5. The method of claim 1, wherein:

said plurality of acoustic devices includes hearing aids under evaluation for prescription to a patient with a predetermined hearing loss.

6. The method of claim 1 where:

said plurality of acoustic devices includes devices for remote communication of speech.

7. The method of claim 1 wherein:

said plurality of acoustic devices includes a human ear as proposed to be altered by a proposed surgical procedure.

8. The method of claim 1 wherein:

weights used in forming said weighted sum are determined from a history of a patient to correspond to the relative importance to the patient of the listening conditions corresponding to each of said weights.

9. The method of claim 1 wherein:

the intelligibility measurements include a factor to quantify distortion or other fidelity limitations of the device.

10. The method of claim 1 wherein:

the intelligibility measurements include a factor to quantify temporal resolving ability.

11. The method of claim 1 wherein:

said weighted sums are formed by integrating said intelligibility measurements over a plurality of signal-to-noise ratios of said listening conditions.

12. The method of claim 1 wherein:

said weighted sums are formed by integrating said intelligibility measurements over a plurality of speech intensity levels of said listening conditions.

13. The method of claim 1 wherein:

said intelligibility measurements are computed as an articulation index of speech in said listening conditions.

14. The method of claim 1 wherein:

said intelligibility measurements are computed as a speech transmission index of speech in said listening conditions.

15. The method of claim 1 further comprising the step of:

combining two of said weighted sums to form an audibility improvement index quantifying a differential benefit to a listener of the devices corresponding to said two weighted sums.

16. The method of claim 1 further comprising the step of:

evaluating a single one of said devices using two different sets of weighting factors in forming the weighted sum corresponding to said device.

17. The method of claim 1 wherein:

one of said acoustic devices is an unaided human ear.

18. A method of determining a hearing aid prescription for a patient, comprising the steps of:

(a) measuring a spectral hearing loss of the patient;

(b) generating a computer model of a hearing aid having a frequency gain characteristic which at least in part compensates for said hearing loss;

performing the steps:

(c) evaluating an articulation index for speech signals amplified by a hearing aid having said frequency gain characteristic under a plurality of listening conditions having varying signal-to-noise ratio and speech intensity levels;

(d) forming a weighted sum of said articulation indices;

(e) generating a new computer model hearing aid having modelled acoustic properties altered to increase said weighted sum;

(f) iteratively repeating steps (c) through (e) until said weighted sums converge at a maximum; and (g) choosing from among the generated hearing aid prescription models the one prescription best overall suited to said plurality of listening conditions, being the prescription having the largest corresponding weighted sum.

* * * * *